US010155386B2

(12) United States Patent
Sugahara

(10) Patent No.: US 10,155,386 B2
(45) Date of Patent: Dec. 18, 2018

(54) INK-JET HEAD

(71) Applicant: BROTHER KOGYO KABUSHIKI KAISHA, Nagoya-shi, Aichi-ken (JP)

(72) Inventor: Hiroto Sugahara, Ama (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/835,065

(22) Filed: Dec. 7, 2017

(65) Prior Publication Data

US 2018/0093477 A1 Apr. 5, 2018

Related U.S. Application Data

(62) Division of application No. 14/977,057, filed on Dec. 21, 2015, now Pat. No. 9,862,188.

(30) Foreign Application Priority Data

Dec. 23, 2014 (JP) ..... 2014-259590

(51) Int. Cl.
*B41J 2/145* (2006.01)
*B41J 2/15* (2006.01)
*B41J 2/165* (2006.01)

(52) U.S. Cl.
CPC ..... *B41J 2/15* (2013.01); *B41J 2/145* (2013.01); *B41J 2/16538* (2013.01)

(58) Field of Classification Search
CPC ..... B41J 2/145; B41J 2/15
See application file for complete search history.

(56) References Cited

U.S. PATENT DOCUMENTS 8,662,635 B2 3/2014 Yuda et al.
9,315,024 B2 4/2016 Miyamoto et al.
2005/0168503 A1* 8/2005 Mitsuzawa ..... B41J 2/2132 347/5
2012/0236057 A1* 9/2012 Sakakibara ..... B41J 19/147 347/14

FOREIGN PATENT DOCUMENTS

JP 2013-159010 A 8/2013
JP 2013-215915 A 10/2013

* cited by examiner

*Primary Examiner* — Kristal Feggins
*Assistant Examiner* — Kendrick Liu
(74) *Attorney, Agent, or Firm* — Merchant & Gould P.C.

(57) ABSTRACT

An ink-jet printer, including: an ink-jet head; and a head moving device for moving the head in a scanning direction, wherein the ink-jet head includes a first head unit having a first nozzle row from which first ink is ejected and a second nozzle row from which second ink that differs in color from the first ink is ejected, a second head unit disposed so as to be shifted from the first head unit in a nozzle arrangement direction by a distance less than a nozzle pitch, and a third head unit disposed between the first and second head units in the scanning direction so as to be shifted from the first head unit in the nozzle arrangement direction by a distance corresponding to a predetermined natural number multiple of the nozzle pitch, the third head unit having fifth and sixth nozzle rows from which the first ink is ejected.

7 Claims, 19 Drawing Sheets

INK-JET HEAD

CROSS REFERENCE TO RELATED APPLICATION

The present application is a divisional application of U.S. patent application Ser. No. 14/977,057, which was filed on Dec. 21, 2015, which claims priority from Japanese Patent Application No. 2014-259590, which was filed on Dec. 23, 2014, the disclosure of which is herein incorporated by reference in its entirety.

BACKGROUND

Technical Field

The following disclosure relates to an ink-jet printer configured to perform printing by ejecting ink from nozzles.

Description of the Related Art

There is known an ink-jet printer configured to perform printing by ejecting ink from nozzles. For instance, the known ink-jet printer includes six heads arranged in a direction (hereinafter referred to as "scanning direction") orthogonal to a sheet conveyance direction and a carriage unit for moving the heads in the scanning direction. Each of the six heads has two nozzle rows. Each nozzle row is formed by a plurality of nozzles arranged at a predetermined nozzle pitch. The nozzles of one of the two rows and the nozzles of the other of the two rows are disposed so as to be shifted relative to each other in the conveyance direction by a distance corresponding to half the nozzle pitch.

In the known ink-jet printer described above, six nozzle rows of left-side three heads in the scanning direction respectively eject light cyan ink, light magenta ink, magenta ink, cyan ink, yellow ink, and black ink in the order from the left, and six nozzle rows of right-side three heads in the scanning direction respectively eject light cyan ink, light magenta ink, magenta ink, cyan ink, yellow ink, and black ink in the order from the right.

In the known the ink-jet printer, the ink is ejected from the nozzles of the six heads while the carriage unit is reciprocated in the scanning direction, whereby printing is performed on a sheet. When printing is thus performed, the ink is ejected from the right-side one of the two nozzle rows of each head while the carriage unit is moved rightward in the scanning direction, and the ink is ejected from the left-side one of the two rows of each head while the carriage unit is moved leftward in the scanning direction. In this instance, the ink is attached to the sheet in the order of light cyan, magenta, yellow, black, cyan, and light magenta anywhere on the sheet, irrespective of the direction of the reciprocating movement of the carriage unit.

Alternatively, the ink is ejected from the left-side one of the two nozzle rows of each head while the carriage unit is moved rightward in the scanning direction, and the ink is ejected from the right-side one of the two nozzle rows of each head while the carriage unit is moved leftward in the scanning direction. In this instance, the ink is attached to the sheet in the order of light magenta, cyan, black, yellow, magenta, and light cyan anywhere on the sheet, irrespective of the direction of the reciprocating movement of the carriage unit.

In the known the ink-jet printer described above, the order of attachment of the ink on the sheet is the same irrespective of the direction of the reciprocating movement of the carriage unit, namely, irrespective of in which one of two directions (rightward and leftward) in the scanning direction the carriage unit moves. It is consequently possible to prevent a printed image from suffering from unevenness in color due to a difference in the order of attachment of the ink on the sheet between the two directions in the scanning direction.

SUMMARY

There has been a demand for high-speed printing in ink-jet printers. The demand for high-speed printing is higher particularly in monochrome printing for printing characters in documents or the like using only black ink, than in color printing for printing pictures or the like using color ink.

One aspect of the disclosure relates to an ink-jet printer in which an order of attachment of ink on a recording medium is the same anywhere on the recording medium irrespective of a direction of a movement of an ink-jet head and which can perform, at a high speed, printing using only one kind of ink such as monochrome printing.

In one aspect of the disclosure, an ink-jet printer includes: an ink-jet head configured to be movable in a scanning direction and to eject ink; and a head moving device configured to move the ink-jet head in the scanning direction, wherein the ink-jet head includes a plurality of head units each of which has two nozzle rows arranged in the scanning direction, each nozzle row being formed by a plurality of ink nozzles from which the ink is ejected and which are arranged at a predetermined nozzle pitch in a nozzle arrangement direction orthogonal to the scanning direction, wherein the plurality of head units include a first head unit, a second head unit disposed so as to be spaced apart from the first head unit in the scanning direction such that the second head unit is shifted from the first head unit in the nozzle arrangement direction by a distance less than the nozzle pitch, a third head unit disposed between the first head unit and the second head unit in the scanning direction such that the third head unit is shifted from the first head unit in the nozzle arrangement direction by a distance corresponding to a predetermined natural number multiple of the nozzle pitch, wherein the first head unit has, as the two nozzle rows, a first nozzle row formed by nozzles, as the plurality of ink nozzles, from which first ink is ejected and a second nozzle row formed by nozzles, as the plurality of ink nozzles, from which second ink that differs in color from the first ink is ejected, wherein the second head unit has, as the two nozzle rows, a third nozzle row formed by nozzles, as the plurality of ink nozzles, from which the first ink is ejected and a fourth nozzle row formed by nozzles, as the plurality of ink nozzles, from which the second ink is ejected, wherein the third head unit has, as the two nozzle rows, a fifth nozzle row and a sixth nozzle row each of which is formed by nozzles, as the plurality of ink nozzles, from which the first ink is ejected, and wherein the second nozzle row is more distant, in the scanning direction, from the second head unit than the first nozzle row and the fourth nozzle row is more distant, in the scanning direction, from the first head unit than the third nozzle row, or the first nozzle row is more distant, in the scanning direction, from the second head unit than the second nozzle row and the third nozzle row is more distant, in the scanning direction, from the first head unit than the fourth nozzle row.

In another aspect of the disclosure, an ink-jet printer includes: an ink-jet head configured to be movable in a scanning direction and to eject ink; and a head moving device configured to move the ink-jet head in the scanning direction, wherein the ink-jet head includes a plurality of head units each of which has a nozzle row formed by a plurality of ink nozzles from which the ink is ejected and which are arranged at a predetermined nozzle pitch in a nozzle arrangement direction orthogonal to the scanning direction, the plurality of head units having mutually the same flow-path structure, wherein the plurality of head units include a first head unit having a first nozzle row formed by nozzles, as the plurality of ink nozzles, from which first ink is ejected, a second head unit disposed alongside the first head unit in the scanning direction and having a second nozzle row formed by nozzles, as the plurality of ink nozzles, from which second ink that differs in color from the first ink is ejected, a third head unit disposed so as to be spaced apart from the first head unit and the second head unit in the scanning direction such that the third head unit is shifted from the first head unit in the nozzle arrangement direction by a distance less than the nozzle pitch, the third head unit having a third nozzle row formed by nozzles, as the plurality of ink nozzles, from which the first ink is ejected, a fourth head unit disposed alongside the third head unit in the scanning direction such that the fourth head unit is located at the same position as the first head unit in the nozzle arrangement direction and such that the fourth head unit is shifted from the second head unit in the nozzle arrangement direction by the distance less than the nozzle pitch, the fourth head unit having a fourth nozzle row formed by nozzles, as the plurality of ink nozzles, from which the second ink is ejected, a fifth head unit disposed between (a) the first head unit and the second head unit and (b) the third head unit and the fourth head unit in the scanning direction, such that the fifth head unit is shifted from the third head unit in the nozzle arrangement direction by a distance corresponding to a predetermined natural number multiple of the nozzle pitch, the fifth head unit having a fifth nozzle row formed by nozzles, as the plurality of ink nozzles, from which the first ink is ejected, and a sixth head unit disposed between (a) the first head unit and the second head unit and (b) the third head unit and the fourth head unit in the scanning direction, so as to be disposed alongside the fifth head unit in the scanning direction and so as to be shifted from the fourth head unit in the nozzle arrangement direction by the distance corresponding to the predetermined natural number multiple of the nozzle pitch, the sixth head unit having a sixth nozzle row formed by nozzles, as the plurality of ink nozzles, from which the first ink is ejected, and wherein the second head unit is more distant, in the scanning direction, from the third head unit and the fourth head unit than the first head unit and the fourth head unit is more distant, in the scanning direction, from the first head unit and the second head unit than the third head unit, or the first head unit is more distant, in the scanning direction, from the third head unit and the fourth head unit than the second head unit and the third head unit is more distant, in the scanning direction, from the first head unit and the second head unit than the fourth head unit.

Here, one head unit is shifted from another head unit in the nozzle arrangement direction by a distance "less than the nozzle pitch" includes a case in which the one head unit is not shifted from another head unit in the nozzle arrangement direction, namely, a case in which the one head unit is located at the same position as another head unit in the nozzle arrangement direction.

BRIEF DESCRIPTION OF THE DRAWINGS

The objects, features, advantages, and technical and industrial significance of the present disclosure will be better understood by reading the following detailed description of one embodiment, when considered in connection with the accompanying drawings, in which.

DETAILED DESCRIPTION OF THE EMBODIMENT

There will be hereinafter described one embodiment.

Overall configuration of ink-jet printer

Figure 1:
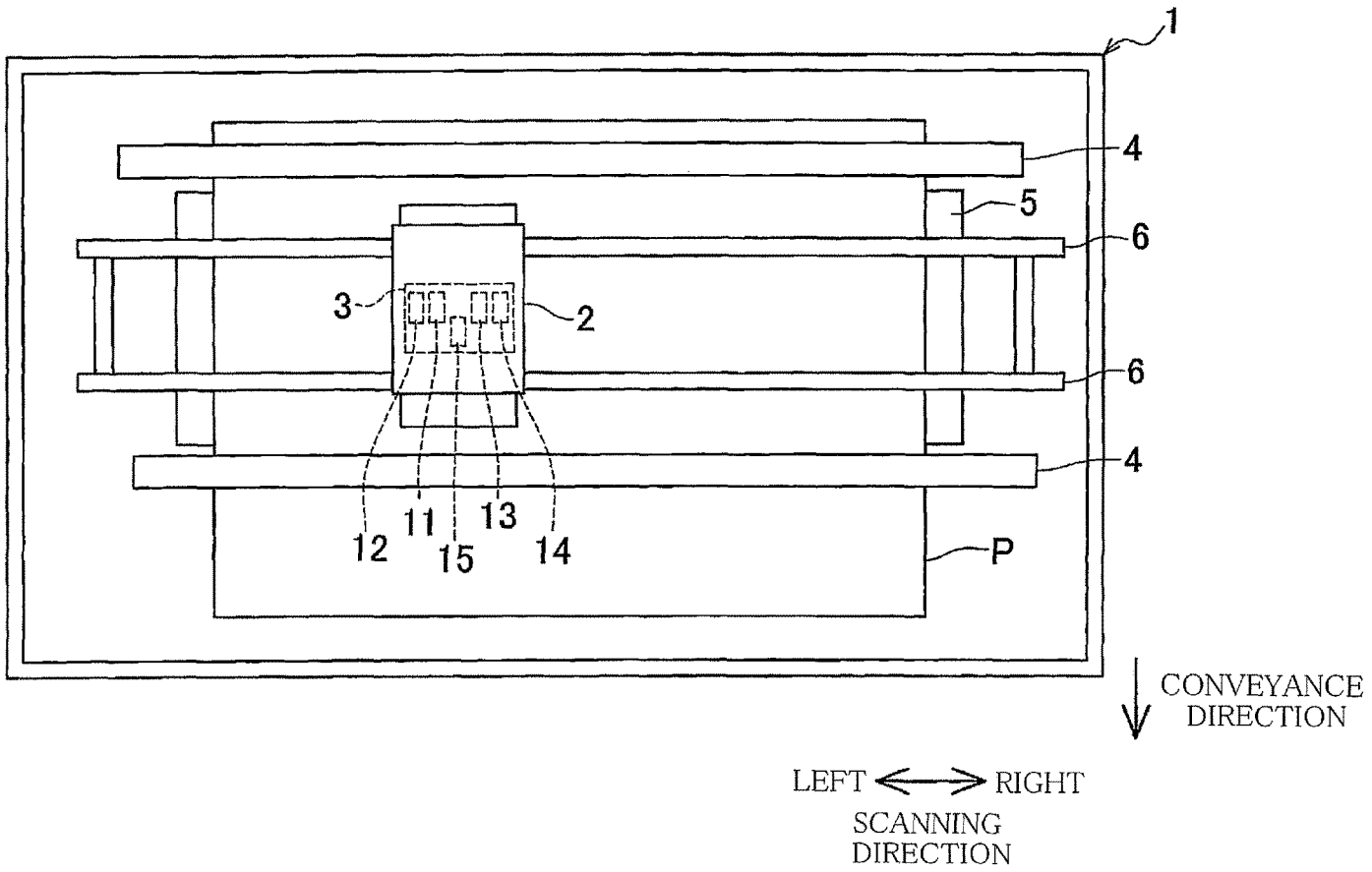
FIG. 1 is a view schematically showing a configuration of an ink-jet printer according to one embodiment.

As shown in FIG. 1, an ink-jet printer 1 according to one embodiment includes a carriage 2, an ink-jet head 3, sheet conveyance rollers 4, and a platen 5. The carriage 2 is supported by two guide rails 6 extending in a scanning direction, so as to be movable in the scanning direction. The carriage 2 is connected to a carriage drive motor 51 (FIG. 3) through a belt and the like (not shown). When the carriage drive motor 51 is driven, the carriage 2 reciprocates in the scanning direction along the guide rails 6. In the present embodiment, a combination of the carriage 2 and the carriage drive motor 51 corresponds to a head moving device.

In the following explanation, a right side and a left side are defined with respect to the scanning direction, as shown in FIG. 1, for instance.

Figure 2:
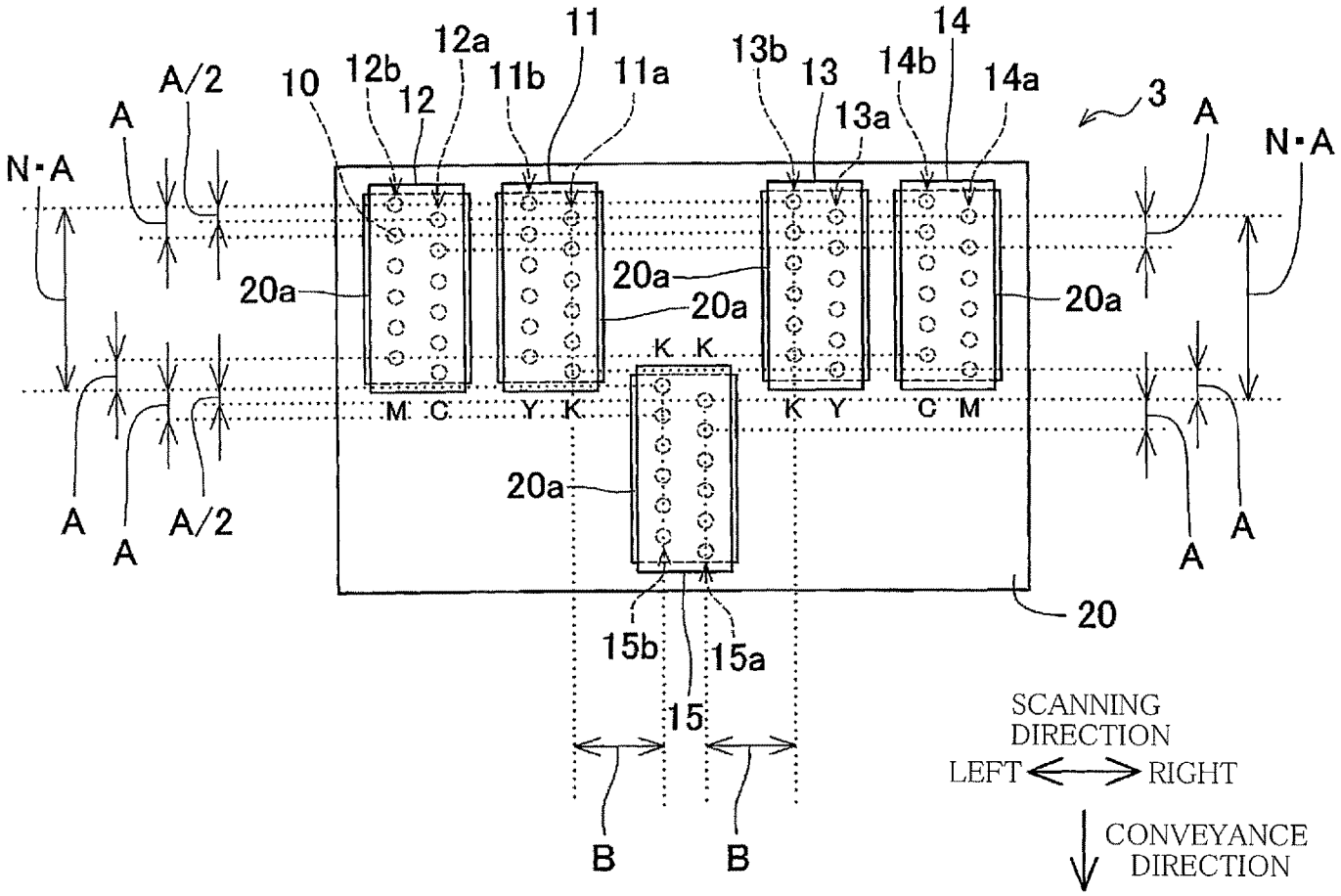
FIG. 2 is a view schematically showing a configuration of an ink-jet head of FIG. 1.
Figure 3:
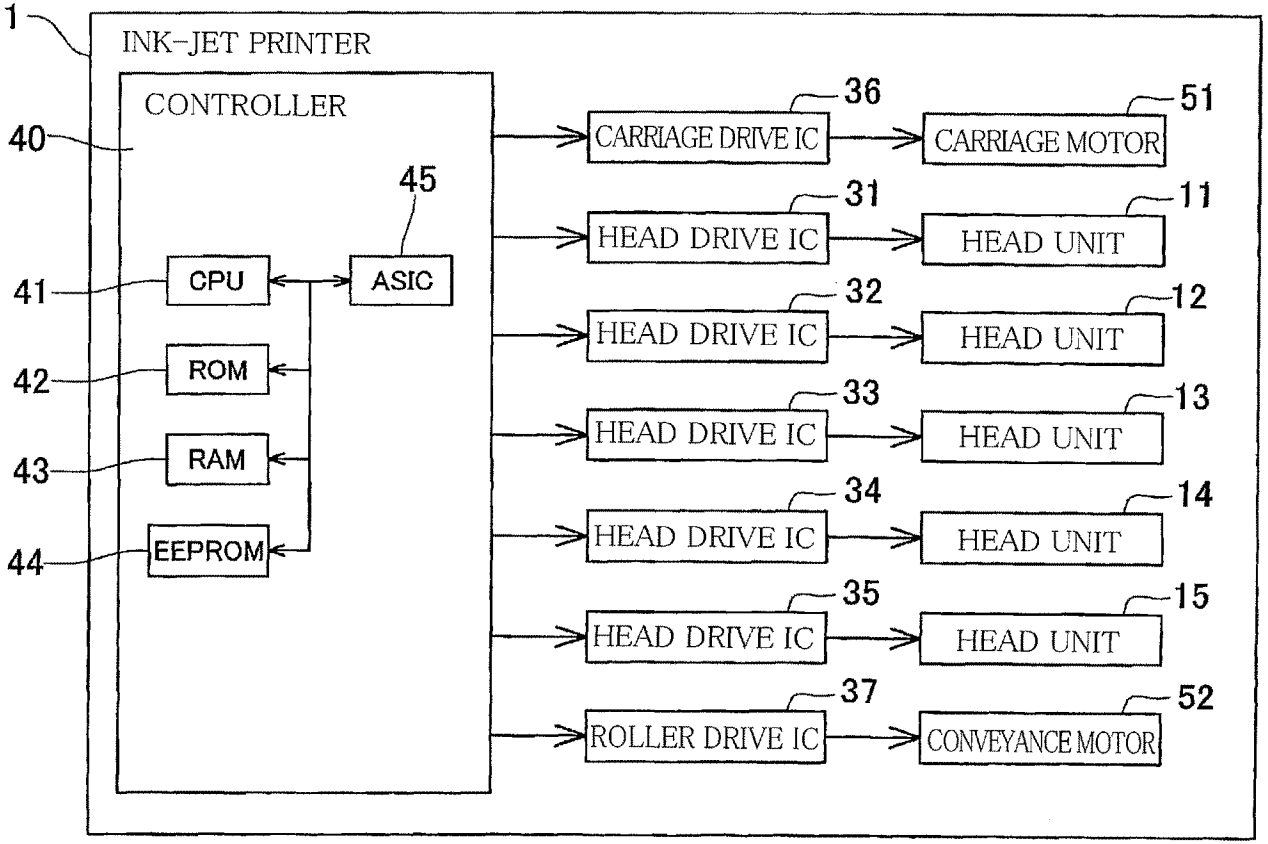
FIG. 3 is a block diagram showing an electric configuration of the ink-jet printer.

The ink-jet head 3 is mounted on the carriage 2. The ink-jet head 3 ejects ink from a plurality of nozzles 10 (FIG. 2) as ink nozzles formed in lower surfaces of respective head units 11-15 (which will be explained). The two sheet conveyance rollers 4 are disposed on one and the other of opposite sides of the carriage 2 in a conveyance direction orthogonal to the scanning direction. The sheet conveyance rollers 4 are connected to a conveyance motor 52 (FIG. 3). When the conveyance motor 52 is driven, the sheet conveyance rollers 4 convey a recording sheet P (as one example of a recording medium) in the conveyance direction. In the present embodiment, a combination of the sheet conveyance rollers 4 and the conveyance motor 52 corresponds to a conveyor device. The platen 5 is disposed under the carriage 2 so as to be opposed to the carriage 2. The platen 5 is configured to support the recording sheet P conveyed by the sheet conveyance rollers 4 from below.

In the ink-jet printer 1, ink is ejected from the ink-jet head 3 that reciprocates with the carriage 2 in the scanning direction while the recording sheet P is conveyed by the sheet conveyance rollers 4 in the conveyance direction. Thus, the ink-jet printer 1 performs printing on the recording sheet P.

Ink-Jet Head

The ink-jet head 3 will be explained. As shown in FIG. 2, the ink-jet head 3 includes five head units 11-15 and a head holder 20 that holds the five head units 11-15.

The head units 11-15 have the same flow-path structure and differ from one another in color of ink ejected from the nozzles 10. The head units 11-15 are disposed so as to be equally spaced apart from one another in the scanning direction.

The head unit 11 (as one example of a first head unit) has two nozzle rows 11*a*, 11*b*. The nozzle row 11*a* (as one example of a first nozzle row) is formed by a plurality of nozzles 10 that are arranged at a predetermined nozzle pitch A in a direction (as one example of a nozzle arrangement direction) parallel to the conveyance direction. The head unit 11 ejects black ink (as one example of first ink) from the nozzles 10 of the nozzle row 11*a*. The nozzle row 11*b* (as one example of a second nozzle row) is formed by a plurality of nozzles 10 that are arranged at the nozzle pitch A in the direction parallel to the conveyance direction. The nozzle row 11*b* is located on the left side of the nozzle row 11*a*. The nozzles 10 of the nozzle row 11*b* are shifted, toward an upstream side in the conveyance direction, from the corresponding nozzles 10 of the nozzle row 11*a* by a distance "A/2" corresponding to half the nozzle pitch A. The head unit 11 ejects yellow ink (as one example of a second ink) from the nozzles 10 of the nozzle row 11*b*. In the drawings such as FIG. 2, "K" and "Y" indicate the color of ink ejected from the nozzles of the nozzle rows. For instance, "K" indicates black and "Y" indicates yellow.

The head unit 12 is disposed alongside the head unit 11 on the left side of the head unit 11. The head unit 12 is located at the same position as the head unit 11 in the conveyance direction. The head unit 12 has two nozzle rows 12*a*, 12*b*. The nozzle row 12*a* is formed by a plurality of nozzles 10 that are arranged at the nozzle pitch A in the direction parallel to the conveyance direction. The head unit 12 ejects cyan ink from the nozzles 10 of the nozzle row 12*a*. The nozzle row 12*b* is formed by a plurality of nozzles 10 that are arranged at the nozzle pitch A in the direction parallel to the conveyance direction. The nozzle row 12*b* is located on the left side of the nozzle row 12*a*. The nozzles 10 of the nozzle row 12*b* are shifted, toward the upstream side in the conveyance direction, from the corresponding nozzles 10 of the nozzle row 12*a* by the distance "A/2" corresponding to half the nozzle pitch A. The head unit 12 ejects magenta ink from the nozzles 10 of the nozzle row 12*b*. In the drawings such as FIG. 2, "C" and "M" indicate the color of ink ejected from the nozzles of the nozzle rows. For instance, "C" indicates cyan and "M" indicates magenta.

The head unit 13(as one example of a second head unit) is disposed on the right side of the head unit 11 so as to be spaced apart from the head unit 11 in the scanning direction. The head unit 13 is located at the same position as the head units 11, 12 in the conveyance direction. The head unit 13 has two nozzle rows 13*a*, 13*b*. The nozzle row 13*a* (as one example of a fourth nozzle row) are formed by a plurality of nozzles 10 that are arranged at the nozzle pitch A in the direction parallel to the conveyance direction. The head unit 13 ejects the yellow ink from the nozzles 10 of the nozzle row 13*a*. The nozzle row 13*b* (as one example of a third nozzle row) are formed by a plurality of nozzles 10 that are arranged at the nozzle pitch A in the direction parallel to the conveyance direction. The nozzle row 13*b* is disposed on the left side of the nozzle row 13*a*. The nozzles 10 of the nozzle row 13*b* are shifted, toward the upstream side in the conveyance direction, from the corresponding nozzles 10 of the nozzle row 13*a* by the distance "A/2" corresponding to half the nozzle pitch A. The head unit 13 ejects the black ink from the nozzles 10 of the nozzle row 13*b*.

The head unit 14 is disposed alongside the head unit 13 on the right side of the head unit 13. The head unit 14 is located at the same position as the head units 11-13 in the conveyance direction. The head unit 14 has two nozzle rows 14*a*, 14*b*. The nozzle row 14*a* are formed by a plurality of nozzles 10 that are arranged at the nozzle pitch A in the direction parallel to the conveyance direction. The head unit 14 ejects the magenta ink from the nozzles 10 of the nozzle row 14*a*. The nozzle row 14*b* are formed by a plurality of nozzles 10 that are arranged at the nozzle pitch A in the direction parallel to the conveyance direction. The nozzle row 14*b* is disposed on the left side of the nozzle row 14*a*. The nozzles 10*b* of the nozzle row 14*b* are shifted, toward the upstream side in the conveyance direction, from the corresponding nozzles 10 of the nozzle row 14*a* by the distance "A/2" corresponding to half the nozzle pitch A. The head unit 14 ejects the cyan ink from the nozzle 10 of the nozzle row 14*b*.

The head unit 15 (as one example of a third head unit) is disposed between the head unit 11 and the head unit 13 in the scanning direction such that the head unit 15 is shifted from the head units 11-14 toward a downstream side in the conveyance direction. The head unit 15 has two nozzle rows 15*a*, 15*b*. The nozzle row 15*a* (as one example of a fifth nozzle row) are formed by a plurality of nozzles 10 that are arranged at the nozzle pitch A in the direction parallel to the conveyance direction. The nozzle row 15*b* (as one example of a sixth nozzle row) are formed by a plurality of nozzles 10 that are arranged at the nozzle pitch A in the direction parallel to the conveyance direction. The nozzle row 15*b* is disposed on the left side of the nozzle row 15*a*. The nozzles 10 of the nozzle row 15*b* are shifted, toward the upstream side in the conveyance direction, from the corresponding nozzles 10 of the nozzle row 15*a* by the distance "A/2" corresponding to half the nozzle pitch A. The black ink is ejected from the nozzles 10 of the nozzle rows 15*a*, 15*b*.

The position of the head unit 15 in the scanning direction and the position of the head unit 15 in the conveyance direction will be explained in detail. The head unit 15 is shifted from the head units 11-14 in the conveyance direction by a distance "N·A" wherein "N" represents the number of nozzles 10 of each of the nozzle rows 11*a*-15*a*, 11*b*-15*b*. Thus, the most downstream one of the nozzles 10 of the nozzle row 11*a* in the conveyance direction and the most upstream one of the nozzles 10 of the nozzle row 15*a* in the conveyance direction are spaced apart from each other by the nozzle pitch A. Further, the most downstream one of the nozzles 10 of the nozzle row 13*b* in the conveyance direction and the most upstream one of the nozzles 10 of the nozzle row 15*b* are spaced apart from each other by the nozzle pitch A.

Here, the explanation is based on the understanding that all of the nozzles 10 of the nozzle rows 11*a*-15*a* and 11*b*-15*b* eject the ink. It is noted however that a part of the nozzles 10 of the nozzle rows 11*a*-15*a* and 11*b*-15*b*, which are located at opposite ends in the conveyance direction, may be dummy nozzles that do not eject the ink. In such a case, the above-indicated number "N" of the nozzles 10 is defined as the number of the nozzles 10 of the nozzle rows 11*a*-15*a*, 11*b*-15*b* that eject the ink.

A distance between the nozzle row 11*a* and the nozzle row 15*b* in the scanning direction and a distance between the nozzle row 13*b* and the nozzle row 15*a* in the scanning direction are mutually the same, namely, the distances are "B". Thus, in printing, the ink-jet head 3 ejects the ink from the nozzles 10 of the nozzle row 15*b* at a position that is shifted, by the distance B in the scanning direction, from a position at which the ink is ejected from the nozzles 10 of the nozzle row 11*a*. Similarly, in printing, the ink-jet head 3 ejects the ink from the nozzles 10 of the nozzle row 15*a* at a position that is shifted, by the distance B in the scanning direction, from the nozzles 10 of the nozzle row 13*b*.

In the arrangement in which the head units 11-15 are disposed as described above, the head unit 11 and the head unit 13 are distant from each other in the scanning direction by a distance greater than that between the head unit 11 and the head unit 12 and that between the head unit 13 and the head unit 14. Focusing on the color of the ink ejected from the nozzles 10 of the ten nozzle rows 11*a*-15*a* and 11*b*-15*b* of the head units 11-15, the arrangement order of the nozzle rows 11*a*-15*a* and the arrangement order of the nozzle rows 11*b*-15*b* are symmetrical with respect to the scanning direction. Specifically, the nozzles 10 of the left-side five nozzle rows 12*b*, 12*a*, 11*b*, 11*a*, 15*b* in the scanning direction respectively eject the magenta ink, the cyan ink, the yellow ink, the black ink, and the black ink. The nozzles 10 of the right-side five nozzle rows 14*a*, 14*b*, 13*a*, 13*b*, 15*a* in the scanning direction respectively eject the magenta ink, the cyan ink, the yellow ink, the black ink, and the black ink.

The head holder 20 is a plate member having a generally rectangular shape. The head holder 20 has five through-holes 20*a*. The five through-holes 20*a* respectively correspond to the five head units 11-15 and have the same positional relationship as that of the head units 11-15. Thus, a distance in the scanning direction between the two through-holes 20*a* corresponding to the head units 11, 13 is greater than a distance between the two through-holes 20*a* corresponding to the head units 11, 12 and a distance between the two through-holes 20*a* corresponding to the two head units 13, 14. Further, the four through-holes 20*a* corresponding to the head units 11-14 are aligned with one another in the scanning direction. The through-hole 20*a* corresponding to the head unit 15 is formed so as to be shifted, toward the downstream side in the conveyance direction, from the four through-holes 20*a* corresponding to the head units 11-14 by the distance "N·A". Further, the through-hole 20 corresponding to the head unit 15 and the four through-holes 20*a* corresponding to the head units 11-14 partially overlap in the conveyance direction as viewed from the scanning direction. The head units 11-15 are held by the head holder 20 such that the head units 11-15 are fitted in the corresponding through-holes 20*a*. In a state in which the head units 11-15 are held by the head holder 20, nozzle surfaces of the head units 11-15, namely, a surface of the ink-jet head 3, in which the nozzles 10 are formed, are downwardly exposed from the through-holes 20*a*.

Electric Configuration of Ink-Jet Printer

There will be next explained an electric configuration of the ink-jet printer 1. As shown in FIG. 3, the ink-jet printer 1 further includes five head drive ICs 31-35, a carriage drive IC 36, a roller drive IC 37, and a controller 40.

The head drive ICs 31-35 are provided respectively for the head units 11-15 so as to drive the corresponding head units 11-15. Specifically, the head drive ICs 31-35 drive the head units 11-15 by applying a drive voltage to the respective head units 11-15.

The carriage drive IC 36 drives a carriage motor (not shown). The roller drive IC 37 drives a conveyance motor (not shown). The head drive ICs 31-35, the carriage drive IC 36, and the roller drive IC 37 are connected to a power supply unit for supplying an electric power thereto. In FIG. 3, illustration of the power supply unit is dispensed with.

Controller

The controller 40 is constituted by a central processing unit (CPU) 41, read only memory (ROM) 42, random access memory (RAM) 43, electrically erasable programmable read only memory (EEPROM) 44, an application specific integrated circuit (ASIC) 45, which cooperate with one another to control operations of the head drive ICs 31-35, the carriage drive IC 36, and the roller drive IC 37. The controller 40 controls operations of the head drive ICs 31-35, thereby controlling operations of the head units 11-15. Further, the controller 40 controls operations of the carriage drive IC 36, thereby controlling operations of the carriage 2. Also, the controller 40 controls operations of the roller drive IC 37, thereby controlling operations of the sheet conveyance rollers 4.

In FIG. 3, only one CPU 41 is illustrated. The controller 40 may have only one CPU 41, and the one CPU 41 may execute processing in a centralized manner. Alternatively, the controller 40 may have a plurality of CPUs 41, and the plurality of CPUs 41 may cooperate to execute processing. In FIG. 3, only one ASIC 45 is illustrated. The controller 40 may have only one ASIC 45, and the one ASIC 45 may execute processing in a centralized manner. Alternatively, the controller 40 may have a plurality of ASICs 45, and the plurality of ASICs 45 may cooperate to execute processing.

Control in Printing

There will be next explained control executed by the controller 40 when printing of an image is performed by the ink-jet printer 1. The ink-jet printer 1 selectively performs one of color printing and monochrome printing owing to the control by the controller 40. The controller 40 executes the control according to a flow chart of FIG. 4, in other words, printing processing according to the flow char of FIG. 4, when printing is performed by the ink-jet printer 1. The controller 40 starts the control flow of FIG. 4 when the controller 40 receives image data based on which an image is to be printed, from a personal computer (PC) or the like connected to the ink-jet printer 1.

Figure 4:
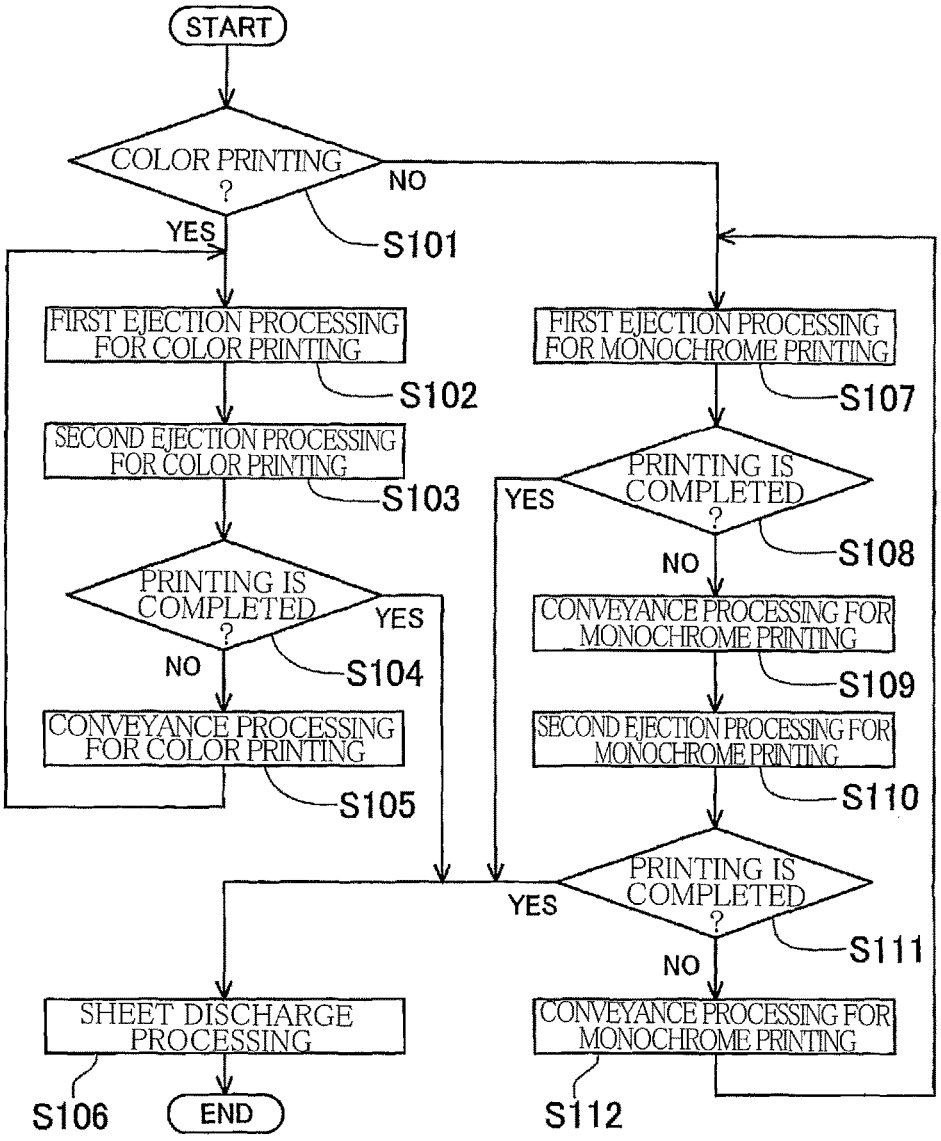
FIG. 4 is a flow chart showing control executed by a controller when printing is performed in the ink-jet printer.

As shown in FIG. 4, the controller 40 initially determines that either the color printing or the monochrome printing is to be performed (S101). The determination at S101 is made based on the received image data, for instance. Alternatively, in a case where a signal to indicate which one of the color printing and the monochrome printing is to be performed according to a user's operation is transmitted to the controller 40, together with the image data, the controller 40 may make the determination at S101 based on the signal received with the image data.

Figure 5A:
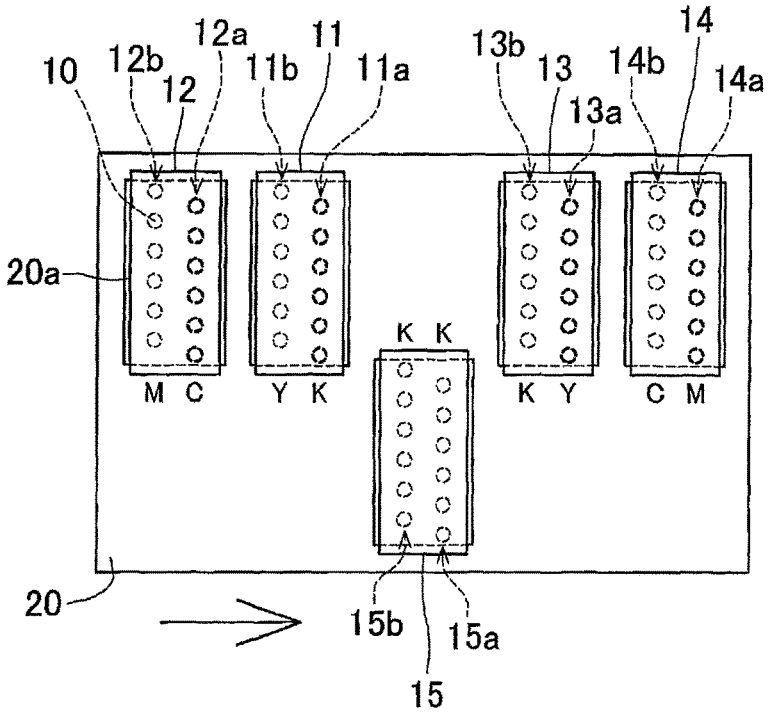
FIG. 5A is a view for explaining first ejection processing for color printing and FIG. 5B is a view for explaining second ejection processing for color printing.

When the color printing is performed (S101: YES), the controller 40 executes first ejection processing for color printing (S102). In the first ejection processing for color printing shown in FIG. 5A, the controller 40 controls the head drive ICs 31-34 and the carriage drive IC 36 such that the ink is ejected from the nozzles 10 of the right-side nozzle rows 11*a*-14*a* of the respective head units 11-14 while the ink-jet head 3 (the carriage 2) is moved rightward. In the drawings such as FIG. 5A, the nozzles 10 from which the ink is ejected are illustrated by the bold line. Thus, the ink is attached to the recording sheet P in the order of magenta, yellow, black, and cyan anywhere on the recording sheet P.

Figure 5B:
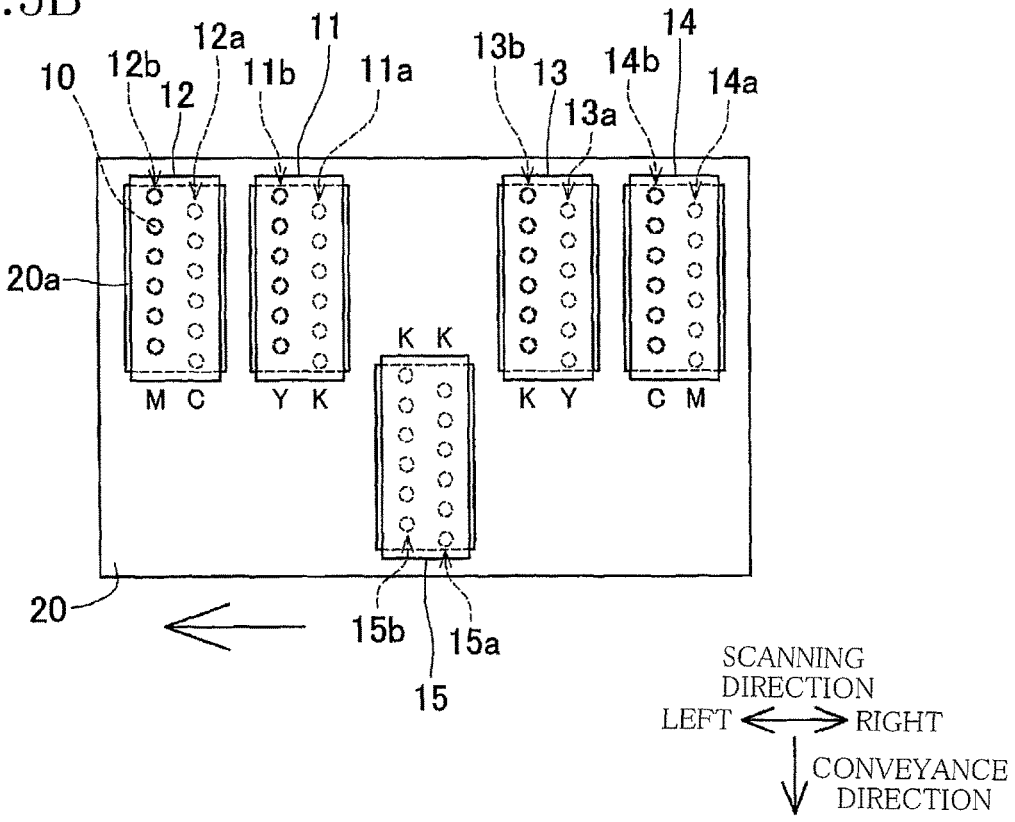

Subsequently, the controller 40 executes second ejection processing for color printing (S103). In the second ejection processing for color printing shown in FIG. 5B, the controller 40 controls the head drive ICs 31-34 and the carriage drive IC 36 such that the ink is ejected from the nozzles 10 of the left-side nozzle rows 11*b*-14*b* of the respective head units 11-14 while the ink-jet head 3 is moved leftward. Thus, the ink is attached to the recording sheet P in the order of magenta, yellow, black, and cyan anywhere on the recording sheet P.

The controller 40 executes the first ejection processing for color printing and the second ejection processing for color printing in this order, so that the ink-jet head 3 makes one reciprocation in the scanning direction during which printing is performed on a region of the recording sheet P having a length "N·A" (a distance "N·A") in the conveyance direction.

When the printing is completed (S104: YES), the controller 40 executes sheet discharge processing (S106), and the printing processing is ended. In the sheet discharge processing at S106, the controller 40 controls the roller drive IC 37 such that the sheet conveyance rollers 4 discharge the recording sheet P. On the other hand, when the printing is not yet completed (S104: NO), the controller 40 executes conveyance processing for color printing (S105), and the control flow returns to S102. In the conveyance processing for color printing at S105, the controller 40 controls the roller drive IC 37 such that the sheet conveyance rollers 4 convey the recording sheet P in the conveyance direction by the distance (N·A).

In this way, S102, S103, and S105 are repeated in the color printing until the printing is completed, so that an image is recorded on the recording sheet P and the recording sheet P on which the printing of the image has been completed is discharged. It is noted that the second ejection processing for color printing at S103 may be executed before the first ejection processing for color printing at S102.

Figure 6A:
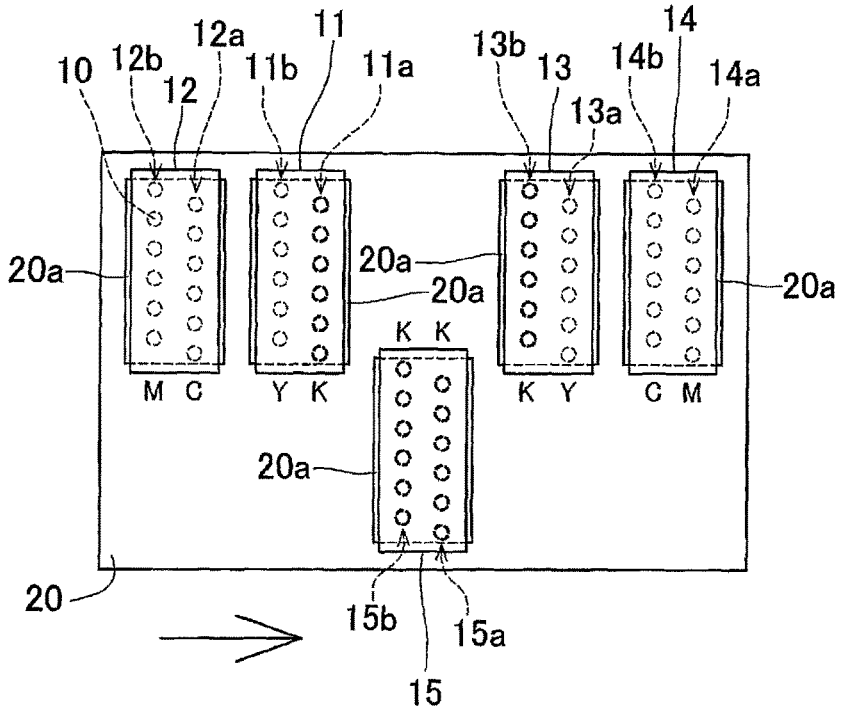
FIG. 6A is a view for explaining first ejection processing for monochrome printing and FIG. 6B is a view for explaining second ejection processing for monochrome printing.

On the other hand, when the monochrome printing is performed (S101: NO), the controller 40 executes first ejection processing for monochrome printing (S107). In the first ejection processing for monochrome printing shown in FIG. 6A, the controller 40 controls the head drive ICs 31, 33, 35 and the carriage drive IC 36 such that the ink is ejected from the nozzles 10 of the respective nozzles row 11*a*, 13*b*, 15*a*, 15*b* while the ink-jet head 3 is moved toward the right side in the scanning direction. Thus, the printing is performed on a region of the recording sheet P having a length "2·[N·A]" (a distance "2·[N·A]" ) in the conveyance direction.

Figure 6B:
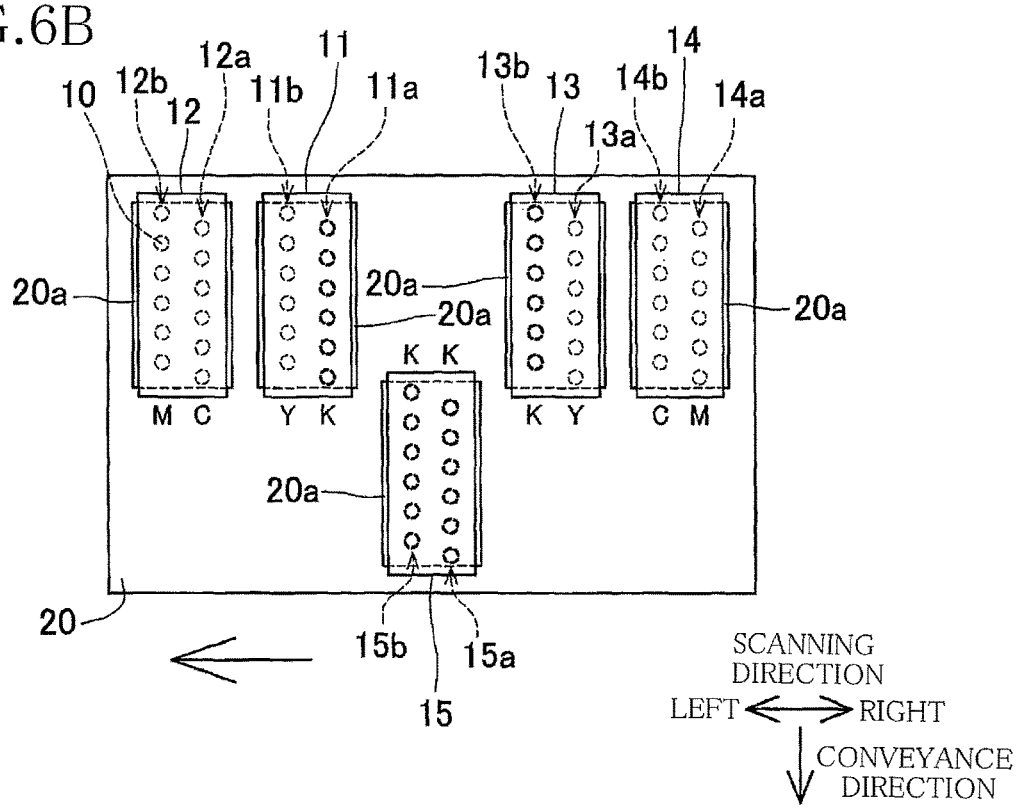

When the printing is completed (S108: YES), the controller 40 executes the sheet discharge processing (S106), and the printing processing is ended. On the other hand, the printing is not yet completed (S108: NO), the controller 40 executes conveyance processing for monochrome printing (S109). In the conveyance processing for monochrome printing, the controller 40 controls the roller drive IC 37 such that the sheet conveyance rollers 4 convey the recording sheet P in the conveyance direction by the distance "2·[N·A]". The controller 40 subsequently executes second ejection processing for monochrome printing (S110). In the second ejection processing for monochrome printing shown in FIG. 6B, the controller 40 controls the head drive ICs 31, 33, 35 and the carriage drive IC 36 such that the ink is ejected from the nozzles 10 of the respective nozzle rows 11*a*, 13*b*, 15*a*, 15*b* while the ink-jet head 3 is moved toward the left side in the scanning direction. Thus, the printing is performed on another region of the recording sheet P having the length "2·[N·A]" in the conveyance direction, the region being adjacent to and located on the downstream side, in the conveyance direction, of the above-indicated region on which the printing has been performed in the first ejection processing for monochrome printing. Thus, the black ink is ejected in the monochrome printing from the nozzles of the nozzle rows 11*a*, 13*b*, 15*a*, 15*b*. Consequently, the monochrome printing using only the black ink can be performed at a higher speed in this arrangement than in an arrangement in which the black ink is ejected in the monochrome printing from the nozzles of only the nozzle rows 11*a*, 13*b*.

When the printing is completed (S111: YES), the controller 40 executes the sheet discharge processing (S106), and the printing processing is ended. On the other hand, when the printing is not yet completed (S111: NO), the controller 40 executes the conveyance processing for monochrome printing similar to that of S109 (S112), and the control flow returns to S107.

In this way, S107, S109, S110, and S112 are repeated in the monochrome printing until the printing is completed, so that an image is recorded on the recording sheet P and the recording sheet P on which the printing of the image has been completed is discharged. It is noted that the second ejection processing for monochrome printing at S108 may be executed before the first ejection processing for monochrome printing at S107.

According to the embodiment explained above, the ink is attached to the recording sheet P in the color printing in the order of magenta, yellow, black, and cyan anywhere on the recording sheet P, irrespective of a movement direction of the ink-jet head 3, namely, irrespective of in which one of two opposite directions (i.e., the rightward direction and the leftward direction) in the scanning direction the ink-jet head 3 is moved. Consequently, the printed image is free from unevenness in color due to a difference in the order of attachment of the ink between the two directions in which the ink-jet head 3 is moved, so that the printed image has a high image quality.

In the color printing, the printing is performed on the region of the recording sheet P having the length "N·A" in the conveyance direction by the first ejection processing for color printing at S102 and the second ejection processing for color printing at S103. That is, in the color printing, the printing is performed on the region of the recording sheet P having the length "N·A" in the conveyance direction during one reciprocation of the ink-jet head 3. In contrast, in the monochrome printing, the printing is performed on the region of the recording sheet P having the length "2·[N·A]" in the conveyance direction by the first ejection processing for monochrome printing at S107. Further, the printing is subsequently performed on another region of the recording sheet P having the length "2·[N·A]" in the conveyance direction by the second ejection processing for monochrome printing at S110. In other words, in the monochrome printing, the printing is performed on the a region of the recording sheet P having a length "4·[N·A]" in the conveyance direction during one reciprocation of the ink-jet head 3. Consequently, the present embodiment achieves high-speed monochrome printing.

In the present embodiment, the black ink is ejected, in the monochrome printing, from the nozzles 10 of the nozzle row 11*a* of the head unit 11, the nozzles 10 of the nozzle row 13*b* of the head unit 13, and the nozzles 10 of the nozzle rows 15*a*, 15*b* of the head unit 15. In this respect, the head unit 15 having the nozzle rows 15*a*, 15*b* is disposed between the head unit 11 and the head unit 13 in the scanning direction. It is thus possible in the present embodiment to decrease a movement distance of the ink-jet head 3 in the first and second ejection processing for monochrome printing, as compared with an arrangement in which the head unit 15 is disposed on the left side of the head unit 11 in the scanning direction (i.e., one of opposite sides of the head unit 11 remote from the head unit 13) or an arrangement in which the head unit 15 is disposed on the right side of the head unit 13 (i.e., one of opposite sides of the head unit 13 remote from the head unit 11). Consequently, high-speed monochrome printing can be achieved.

According to the present ink-jet head 3 having the five head units 11-15 that have mutually the same structure, the order of attachment of the ink can be made equal in the color printing irrespective of the movement direction of the ink-jet head 3, and the printing can be performed at a high speed in the monochrome printing.

For performing the monochrome printing, the ejection timing of the ink from the nozzles 10 needs to be made different differ among the nozzle rows 11*a*, 13*b*, 15*a*, and 15*b*. In the present embodiment, the distance between the nozzle row 11*a* and the nozzle row 15*b* in the scanning direction and the distance between the nozzle row 13*b* and the nozzle row 15*a* in the scanning direction are the same, i.e., "B", as described above. In the monochrome printing, therefore, a difference in the ejection timing of the ink from the nozzles 10 between the nozzle row 13*b* and the nozzle row 15*a* is equal to a difference in ejection timing of the ink from the nozzles 10 between the nozzle row 11*a* and the nozzle row 15*b*. It is consequently possible to easily control the ejection timing of the ink from the nozzles 10 of the respective nozzle rows 11*a*, 13*b*, 15*a*, and 15*b*.

In the present embodiment, the head unit 15 is disposed so as to be shifted from the head units 11-14 toward the downstream side in the conveyance direction by the distance "N·A". Consequently, the nozzles 10 of the nozzle rows 15*a*, 15*b* do not overlap the nozzles of the nozzle rows 11*a*, 13*b* in the conveyance direction as viewed from the scanning direction. It is thus possible to maximize a length, in the conveyance direction, of a region of the ink-jet head 3 in which the nozzles 10 of the nozzle rows 11*a*, 13*b*, 15*a*, and 15*b* from which the black ink is ejected are disposed. As a result, the speed of the monochrome printing can be made as high as possible.

In the present embodiment, the nozzles 10 of the nozzle rows 11*b*-15*b* are shifted from the nozzles 10 of the nozzle rows 11*a*-15*a* toward the upstream side in the conveyance direction by the distance "A/2". Thus, the nozzles 10 for ejecting the ink of different colors are disposed every "A/2" in the conveyance direction, whereby high-resolution printing is achieved.

In the present embodiment, the head unit 15 is disposed so as to be shifted from the head units 11-14 toward the downstream side in the conveyance direction. When the black ink is ejected from the nozzles 10 of the nozzle rows 15*a*, 15*b* in the first and second ejection processing for monochrome printing at S107 and S110, mist of the black ink is generated. The mist of the black ink flows downstream in the conveyance direction by an air flow generated by the movement of the recording sheet P when the recording sheet P is moved in the conveyance direction in the subsequent conveyance processing for monochrome printing at S109, S112 or in the sheet discharge processing at S106. As a result, the mist of the black ink is prevented from being attached to the head units 11-14 disposed upstream of the head unit 15 in the conveyance direction and having the nozzles 10 for ejecting the color ink (yellow ink, cyan ink, magenta ink) and from being accordingly mixed with the color ink.

Modifications

There will be hereinafter described modifications of the illustrated embodiment.

Figure 7A:
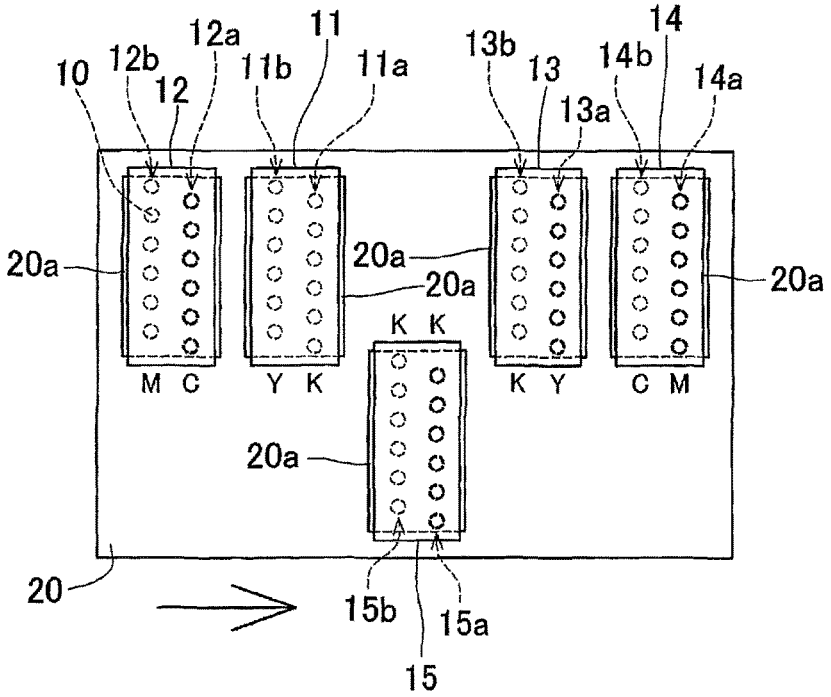
FIGS. 7A and 7B are views for explaining a first modification and respectively correspond to FIGS. 5A and 5B.
Figure 7B:
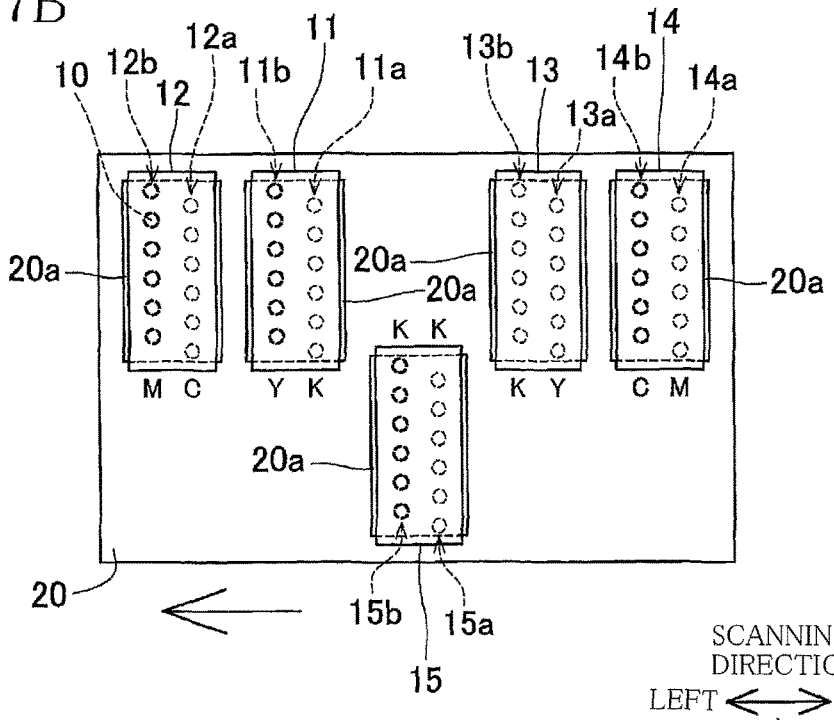
Figure 7B:
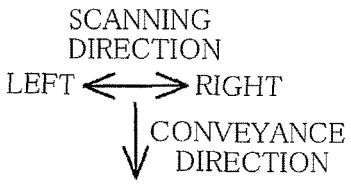

In the illustrated embodiment, the black ink is ejected from the nozzles 10 of the nozzle rows 11*a*, 13*b* in the color printing. The black ink may be ejected from the nozzles 10 of other nozzle rows in the color printing. In a first modification, the black ink is ejected from the nozzles 10 of the nozzle row 15*a* in the first ejection processing for color printing, as shown in FIG. 7A, in place of the nozzles 10 of the nozzle row 11*a*. Further, the black in is ejected from the nozzles 10 of the nozzle row 15*b* in the second ejection processing for color printing, as shown in FIG. 7B, in place of the nozzles 10 of the nozzle row 13*b*.

In this case, the ink is attached to the recording sheet P in the order of magenta, yellow, and cyan anywhere on the recording sheet P, irrespective of the movement direction of the ink-jet head 3. Further, to a region of the recording sheet P to which the color ink ejected from the nozzles 10 of the nozzle rows 11*b*, 12*a*, 12*b*, 13*a*, 14*a*, 14*b* has been attached in certain first and second ejection processing for color printing, the black ink ejected from the nozzles 10 of the nozzle rows 15*a*, 15*b* in subsequent first and second ejection processing for color printing is attached. Consequently, a time before the black ink is attached after the color ink has been attached is longer anywhere on the recording sheet P in this first modification than in the illustrated embodiment. Consequently, the black ink is attached after the previously attached color ink has been sufficiently dried, so that the black ink and the color ink are unlikely to mix with each other. It is thus possible to print an image having a clear boundary between a portion formed by the black ink and a portion formed by the color ink.

Figure 8A:
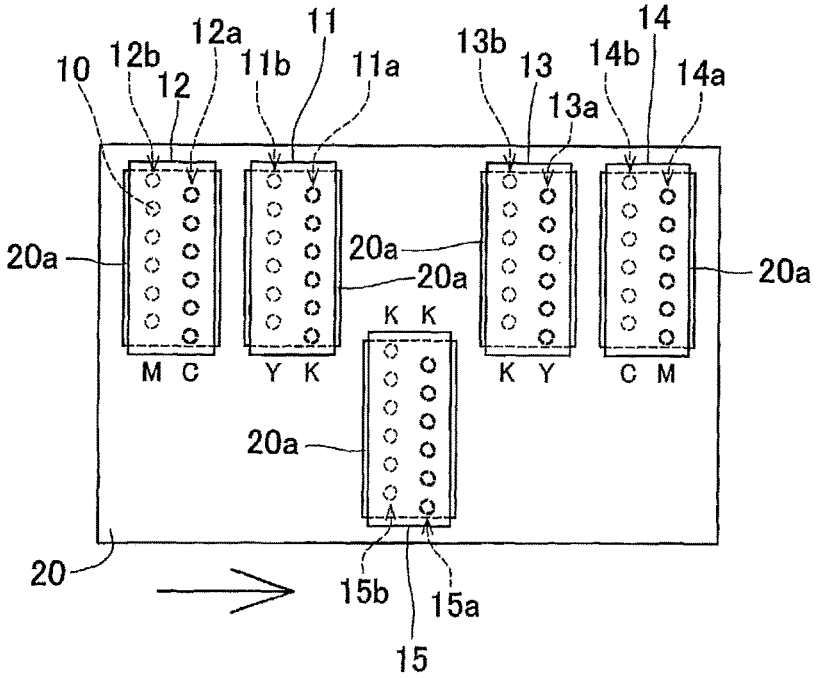
FIGS. 8A and 8B are views for explaining a second modification and respectively correspond to FIGS. 5A and 5B.
Figure 8B:
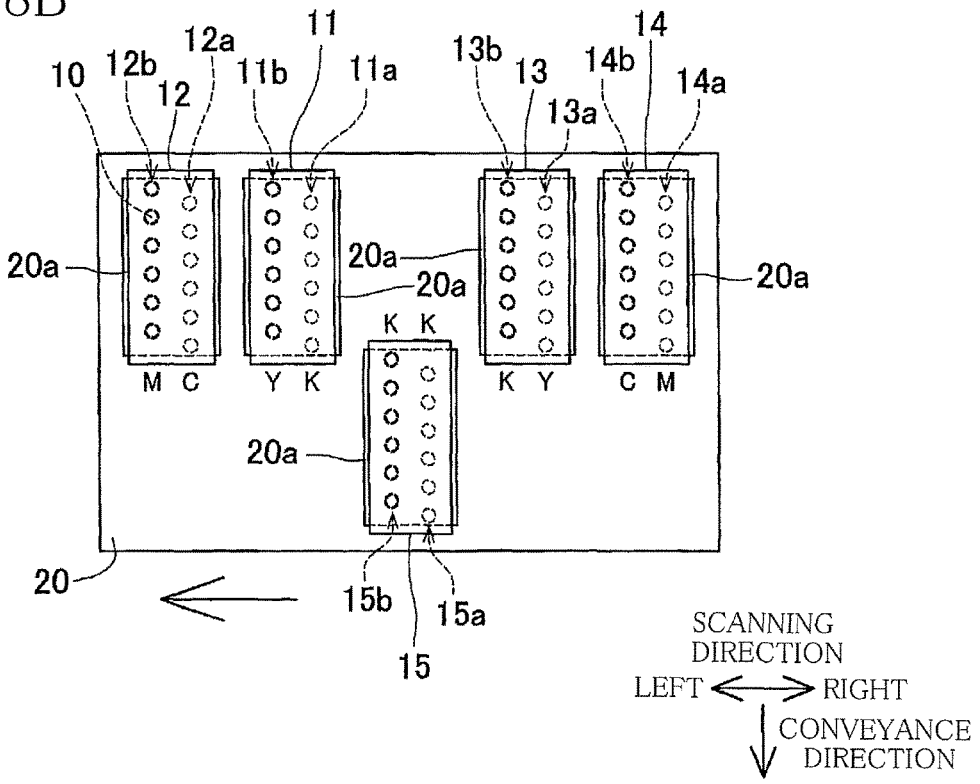

In the illustrated embodiment, even if the duty with respect to each of the nozzle rows 11*a*, 13*b* is maximized in the color printing, there may be a possibility that a portion of the printed image formed by the black ink has a lower density than a portion of the printed image formed by the color ink, due to some factors such as characteristics of the ink. In a second modification, therefore, the black ink is ejected also from the nozzles 10 of the nozzle row 15*a* in the first ejection processing for color printing, as shown in FIG. 8A, in addition to the nozzles 10 of the nozzle row 11*a*. Further, the black ink is ejected also from the nozzles 10 of the nozzle row 15*b* in the second ejection processing for color printing, as shown in FIG. 8B, in addition to the nozzles 10 of the nozzle row 13*b*.

In this instance, the black ink ejected from the nozzles 10 of the nozzle rows 15*a*, 15*b* in certain first and second ejection processing for color printing is attached so as to be superposed on the black ink that has been ejected from the nozzles 10 of the nozzle rows 11*a*, 13*b* and attached to the recording sheet P in immediately previous first and second ejection processing for color printing. It is consequently possible to increase the density of the portion of the printed image formed by the black ink in this second modification than in the illustrated embodiment.

In the second modification, operations of the ink-jet head performed by the first and second ejection processing for color printing include both of a first ejection operation and a second ejection operation. More specifically, when focusing on certain first and second ejection processing for color printing and immediately subsequent first and second ejection processing for color printing, the ejection operation for ejecting the black ink from the nozzles 10 of the nozzle rows 11*a*, 13*b* while the ink-jet head 3 is moved in the scanning direction, in the certain first and second ejection processing for color printing, corresponds to the first ejection operation. Further, the ejection operation for ejecting the black ink from the nozzles 10 of the nozzle rows 15*a*, 15*b* while the ink-jet head 3 is moved in the scanning direction, in the immediately subsequent first and second ejection processing for color printing, corresponds to the second ejection operation. In the second modification, the recording sheet P is conveyed in the conveyance direction by the distance (N·A) between the first ejection operation and the second ejection operation.

Figure 9:
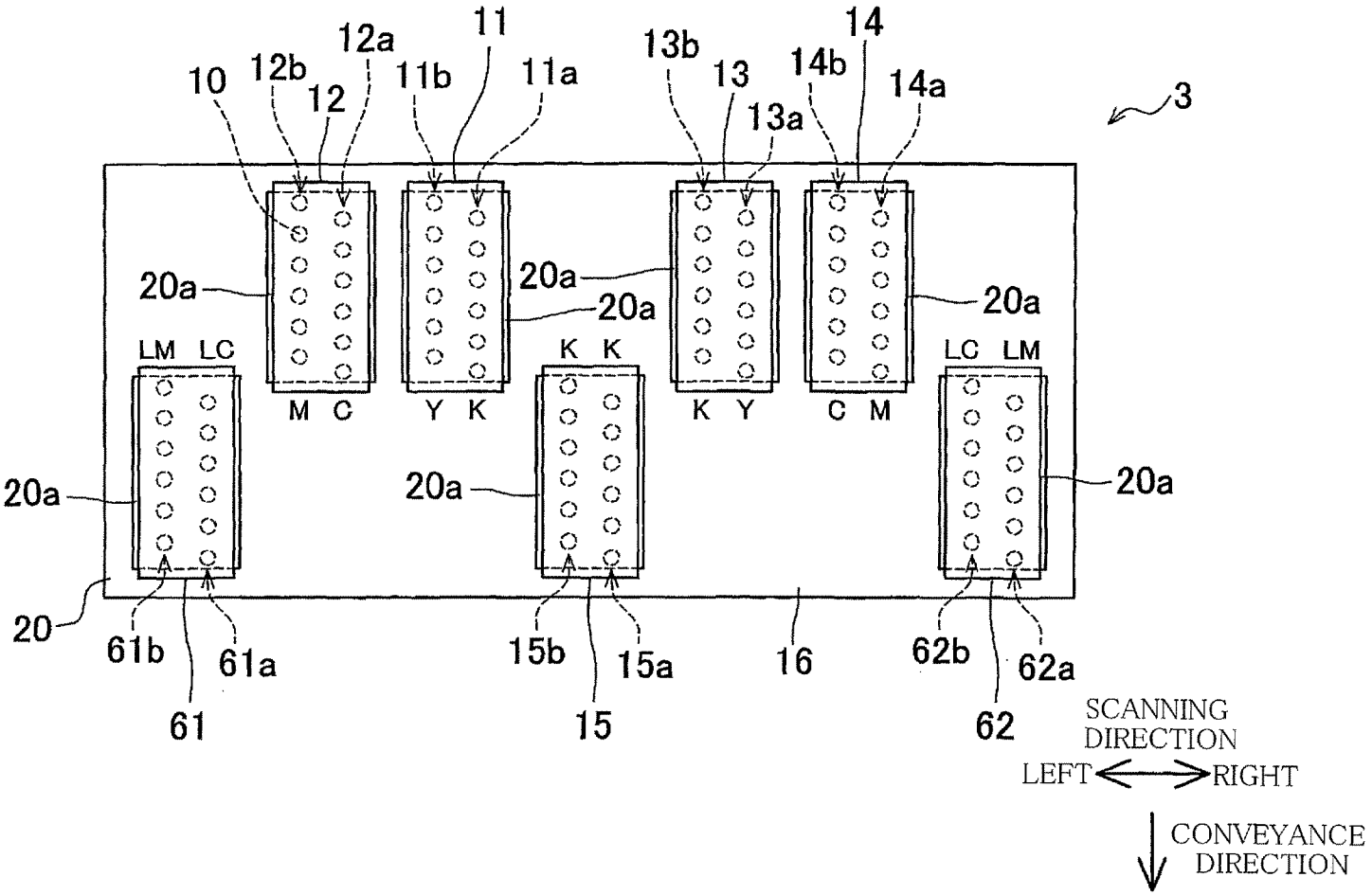
FIG. 9 is a view for explaining a third modification and corresponds to FIG. 2.

In the illustrated embodiment, the ink-jet head 3 is configured to eject ink of four colors, i.e., black, yellow, cyan, and magenta. The ink-jet head 3 may be configured to eject ink of other colors. In a third modification shown in FIG. 9, the ink-jet head 3 further has head units 61, 62 having the same structure as the head units 11-15.

The head unit 61 is disposed on the left side of the head unit 12 in the scanning direction. The head unit 62 is disposed on the right side of the head unit 14 in the scanning direction. The head units 61, 62 are located at the same position as the head unit 15 in the conveyance direction.

The head unit 61 has a nozzle row 61*a* and a nozzle row 61*b* disposed on the left side of the nozzle row 61*a*. The head unit 61 ejects light cyan ink from the nozzles 10 of the nozzle row 61*a* and light magenta ink from the nozzles 10 of the nozzle row 61*b*. The head unit 62 has a nozzle row 62*a* and a nozzle row 62*b* disposed on the left side of the nozzle row 62*a*. The head unit 62 ejects the light magenta ink from the nozzles 10 of the nozzle row 62*a* and the light cyan ink from the nozzles 10 of the nozzle row 62*b*. In the third modification, each of the light cyan ink and the light magenta ink corresponds to light color ink, and each of the nozzle rows 61*a*, 61*b*, 62*a*, 62*b* corresponds to a light-color nozzle row.

In the third modification, the ink is ejected from the nozzles 10 of the nozzle rows 11*a*-14*a*, 61*a*, 62*a* in the first ejection processing for color printing at S102. Further, the ink is ejected from the nozzles 10 of the nozzle rows 11*b*-14*b*, 61*b*, 62*b* in the second ejection processing for color printing at S103. In this instance, the ink is attached to the recording sheet P in the color printing in the order of magenta, yellow, black, and cyan anywhere on the recording sheet P, irrespective of the movement direction of the ink-jet head 3. Further, the ink is attached in the order of light magenta and light cyan, irrespective of the movement direction of the ink-jet head 3 to a region of the recording sheet P adjacent to and downstream of a region of the recording sheet P to which the ink has been attached in the order of magenta, yellow, black, and cyan, irrespective of the movement direction of the ink-jet head 3.

In this case, on the black ink, the yellow ink, the cyan ink, and the magenta ink ejected from the nozzles 10 of the nozzle rows 11*a*-14*a* and the nozzle rows 11*b*-14*b* in certain ejection processing for color printing, the light cyan ink and the light magenta ink ejected from the nozzles 10 of the nozzles rows 61*a*, 61*b*, 62*a*, 62*b* in immediately subsequent ejection processing for color printing are attached and superposed. Consequently, the light cyan ink and the light magenta ink are attached to and superposed on the previously attached black ink, yellow ink, cyan ink, and magenta ink after the previously attached black ink, yellow ink, cyan ink, and magenta ink have been sufficiently dried. Thus, the light cyan ink and the light magenta ink are unlikely to mix with the black ink, the yellow ink, the cyan ink, and the magenta ink which are darker than the light cyan ink and the light magenta ink, so that the printed image has a high image quality.

Figure 10:
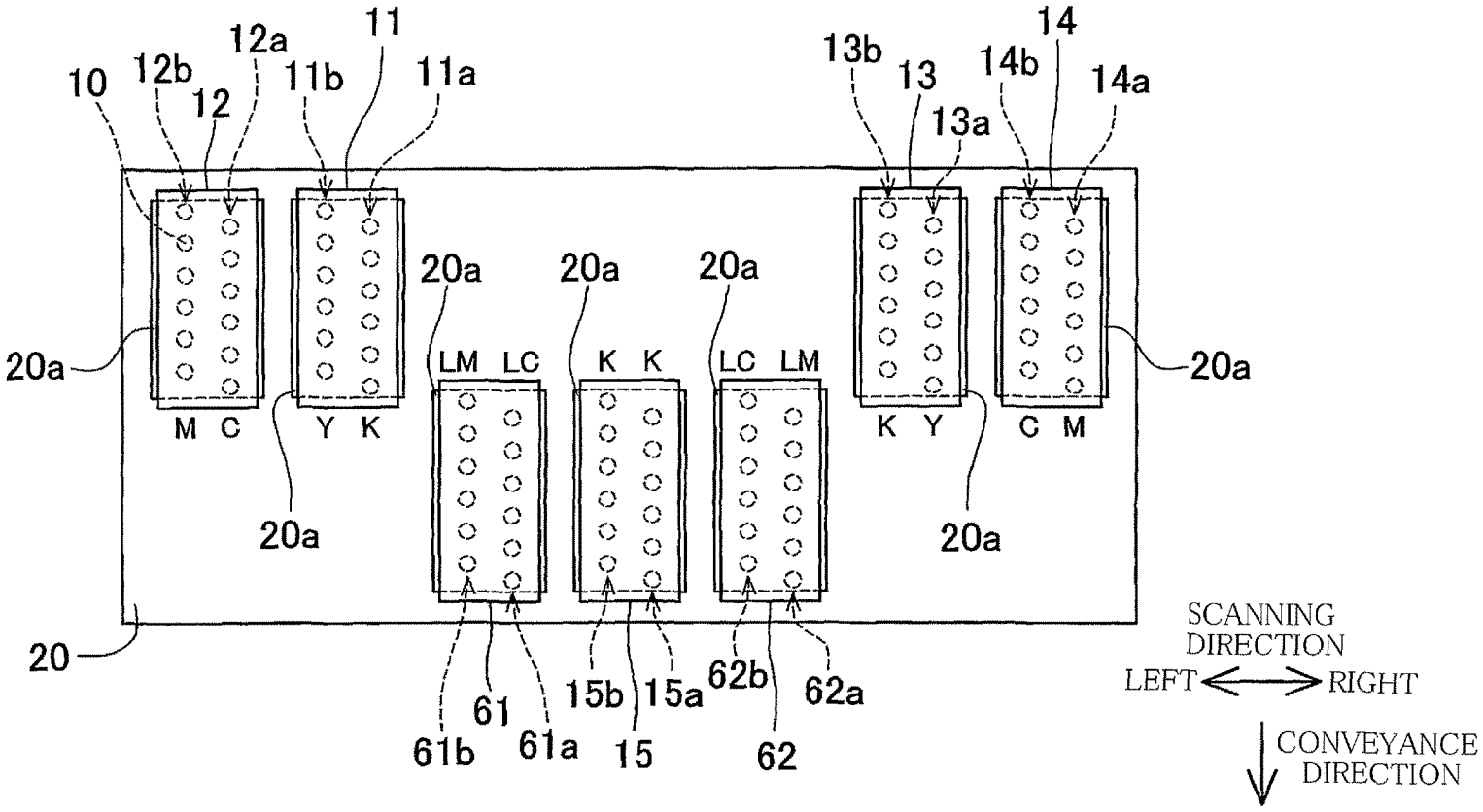
FIG. 10 is a view for explaining a fourth modification and corresponds to FIG. 2.

In the third modification, the head unit 61 is disposed on the left side of the head unit 12 in the scanning direction, and the head unit 62 is disposed on the right side of the head unit 14 in the scanning direction. The head units 61, 62 may be disposed otherwise. In a fourth modification shown in FIG. 10, the head unit 61 is disposed between the head unit 11 and the head unit 15 in the scanning direction, and the head unit 62 is disposed between the head unit 13 and the head unit 15 in the scanning direction.

The position of the head units 61, 62 in the conveyance direction need not necessarily be the same as the position of the head unit 15 in the conveyance direction. The position of the head units 61, 62 in the conveyance direction may be the same as the position of the head units 11-14 in the conveyance direction.

The ink-jet head 3 need not necessarily eject the color ink of a plurality of colors from the nozzles 10. For instance, the ink-jet head may be configured to have only three head units 11, 13, 15.

In the illustrated embodiment, the distance between the nozzle row 11*a* and the nozzle row 15*b* in the scanning direction and the distance between the nozzle row 13*b* and the nozzle row 15*a* in the scanning direction are the same distance "B". However, the head unit 15 may be shifted from the position in the illustrated embodiment toward the right side or the left side in the scanning direction within an area between the head unit 11 and the head unit 13. In other words, the distance between the nozzle row 11*a* and the nozzle row 15*b* in the scanning direction and the distance between the nozzle row 13*b* and the nozzle row 15*a* in the scanning direction may be mutually different.

Figure 11:
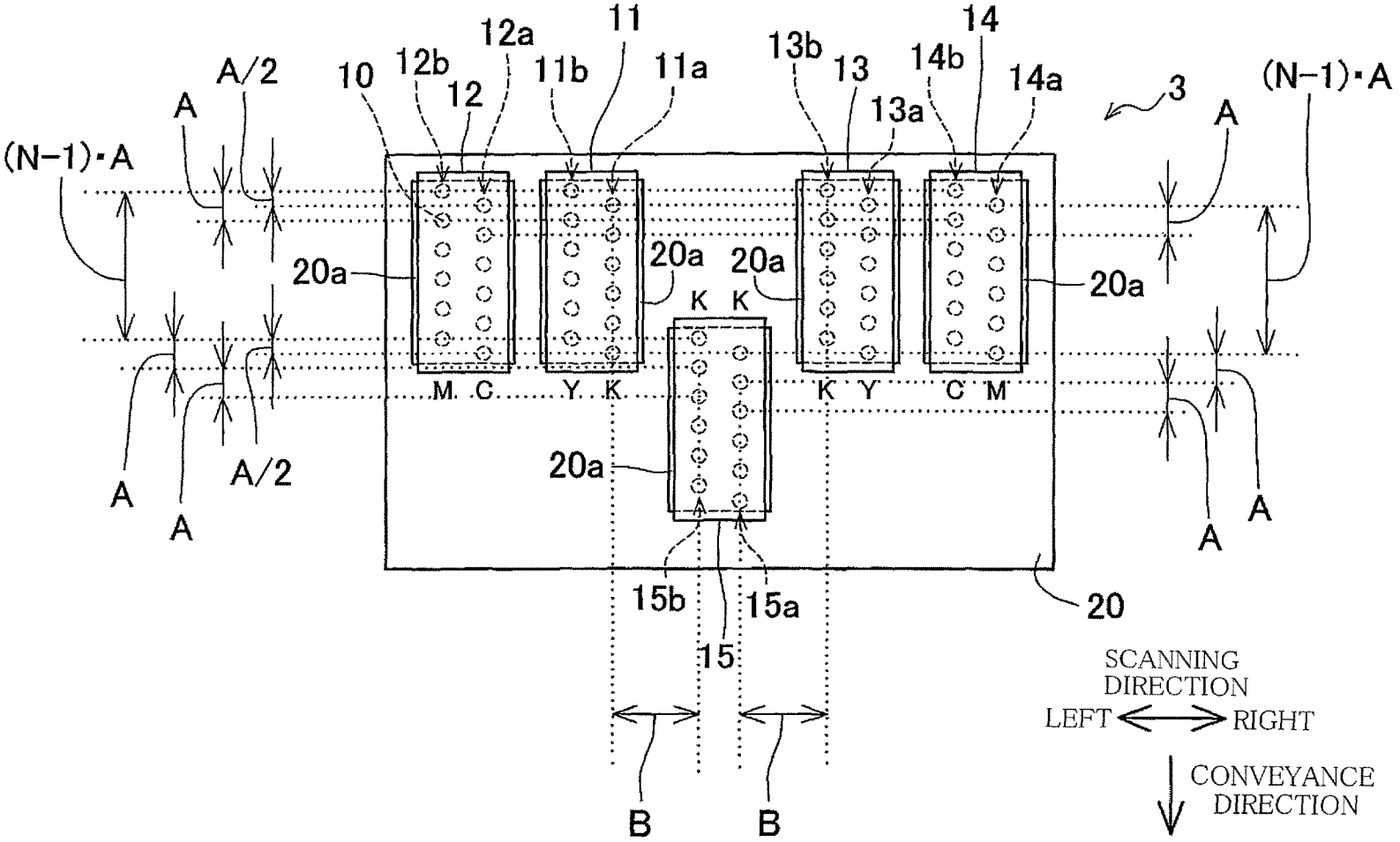
FIG. 11 is a view for explaining a fifth modification and corresponds to FIG. 2.

In the illustrated embodiment, the head unit 15 is disposed so as to be shifted from the head units 11-14 toward the downstream side in the conveyance direction by the distance "N·A". The head unit 15 may be disposed otherwise. In a fifth modification shown in FIG. 11, the head unit 15 is disposed so as to be shifted from the head units 11-14 toward the downstream side in the conveyance direction by a distance "H·A" wherein "H" is a natural number less than N. FIG. 11 shows an arrangement in which H=N−1.

In this arrangement, a part of the nozzles 10 of the nozzle row 11*a* and a part of the nozzles 10 of the nozzle row 15*a* are disposed at the same position in the conveyance direction, and a part of the nozzles 10 of the nozzle row 13*b* and a part of the nozzles 10 of the nozzle row 15*b* are disposed at the same position in the conveyance direction. Consequently, in the first and second ejection processing for monochrome printing, the ink is ejected from only one of two nozzles 10 of the nozzle rows 11*a*, 15*a* having the same position in the conveyance direction. Further, in the first and second ejection processing for monochrome printing, the ink is ejected from only one of the two nozzles 10 of the nozzle rows 13*b*, 15*b* disposed at the same position in the conveyance direction.

In the illustrated embodiment, the ink is ejected in the first ejection processing for color printing from the nozzles 10 of the right-side nozzle rows 11*a*-14*a* of the head units 11-14 while the ink is ejected in the second ejection processing for color printing from the nozzles 10 of the left-side nozzle rows 11*b*-14*b* of the head units 11-14. The ink may be ejected otherwise. That is, the ink may be ejected in the first ejection processing for color printing from the nozzles 10 of the left-side nozzle rows 11*b*-14*b* of the head units 11-14 while the ink may be ejected in the second ejection processing for color printing from the nozzles 10 of the right-side nozzle rows 11*a*-14*a* of the head unit 11-14. In this instance, in the color printing, the ink is attached to the recording sheet P in the order of cyan, black, yellow, and magenta anywhere on the recording sheet P, irrespective of the movement direction of the ink-jet head 3.

In the illustrated embodiment, the yellow ink is ejected from the nozzles 10 of the nozzle rows 11*b*, 13*a*, the cyan ink is ejected from the nozzles 10 of the nozzle rows 12*a*, 14*b*, and the magenta ink is ejected from the nozzles 10 of the nozzle rows 12*b*, 14*a*. However, the colors of the ink ejected from the nozzles of these nozzle rows may differ from those in the illustrated embodiment as long as the color of the ink is the same between the nozzle row 11*b* and the nozzle row 13*a*, between the nozzle row 12*a* and the nozzle row 14*b*, and between the nozzle row 12*b* and the nozzle row 14*a*.

In the illustrated embodiment, the black ink is ejected from the nozzles 10 of the nozzle rows 11*a*, 13*b*, and the yellow ink is ejected from the nozzles 10 of the nozzle rows 11*b*, 13*a*. However, the yellow ink may be ejected from the nozzles 10 of the nozzle rows 11*a*, 13*b*, and the black ink may be ejected from the nozzles 10 of the nozzle rows 11*b*, 13*a*. In this instance, the ink is attached, in the color printing, to the recording sheet P in the order of magenta, black, yellow, and cyan anywhere on the recording sheet P, irrespective of the movement direction of the ink-jet head 3.

In the illustrated embodiment, the head unit 15 is disposed so as to be shifted from the head units 11-14 toward the downstream side in the conveyance direction. However, the head unit 15 may be disposed so as to be shifted from the head units 11-14 toward the upstream side in the conveyance direction.

In the illustrated embodiment, the black ink is ejected from the nozzles 10 of the nozzle rows 11*a*, 13*b*, 15*a*, 15*b* for achieving high-speed monochrome printing using only the black ink. However, the ink having a color other than black may be ejected from the nozzles 10 of the nozzle rows 11*a*, 13*b*, 15*a*, 15*b* for achieving high-speed printing using only the ink having the color in question.

In the illustrated embodiment, the nozzles 10 of the nozzle rows 11*b*-15*b* are shifted from the nozzles 10 of the nozzle rows 11*a*-15*a* toward the upstream side in the conveyance direction by the distance "A/2". However, the nozzles 10 of the nozzle rows 11*b*-15*b* may be shifted from the nozzles 10 of the nozzle rows 11*a*-15*a* toward the downstream side in the conveyance direction by the distance "A/2".

Figure 12:
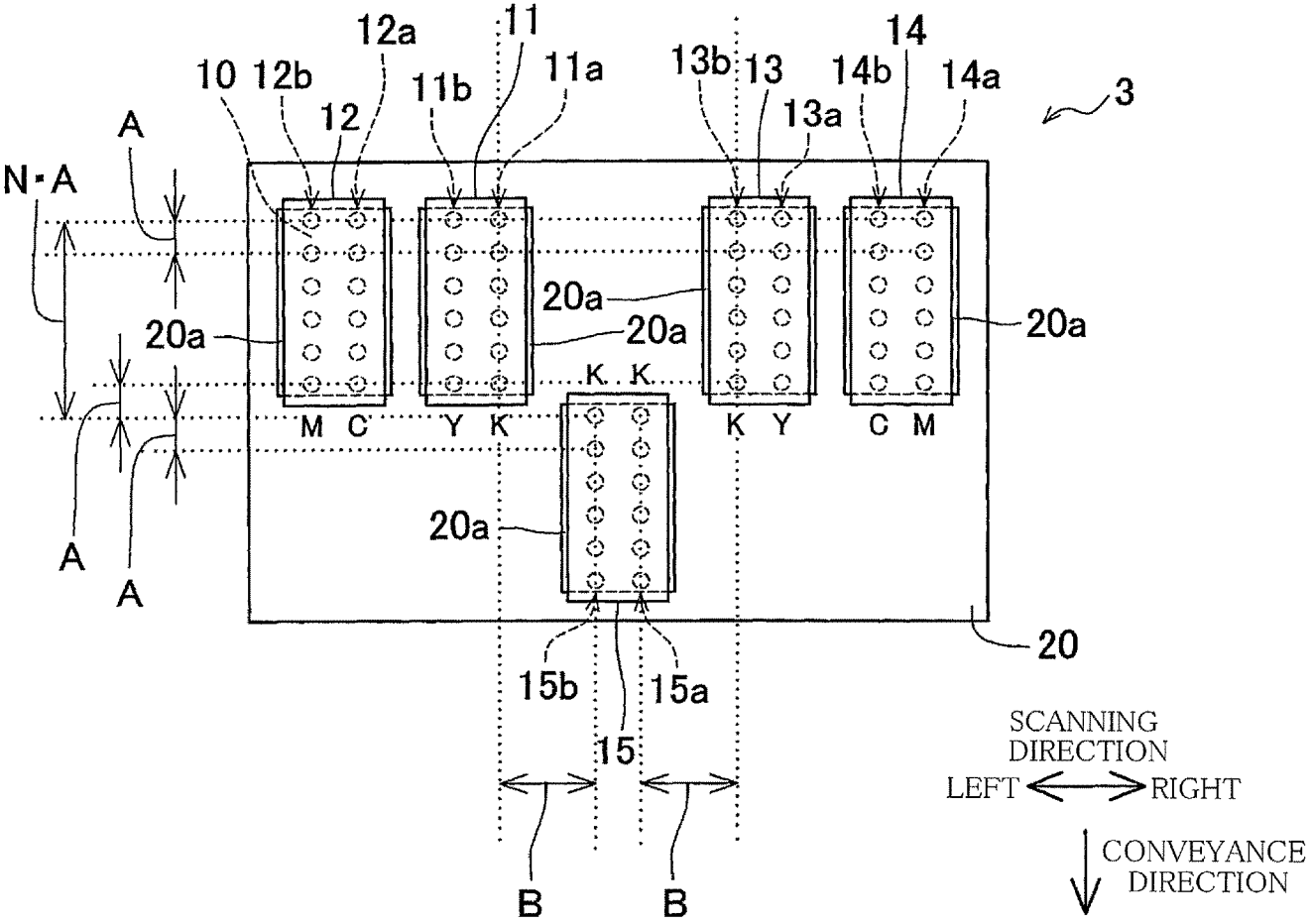
FIG. 12 is a view for explaining a sixth modification and corresponds to FIG. 2.

Further, the nozzles 10 of the nozzle rows 11*b*-15*b* need not necessarily be shifted from the nozzles 10 of the nozzle rows 11*a*-15*a* in the conveyance direction by the distance "A/2". In a sixth modification shown in FIG. 12, the nozzles 10 of the nozzle rows 11*a*-14*a* and the nozzles 10 of the nozzle rows 11*b*-14*b* are located at the same position in the conveyance direction.

Figure 13:
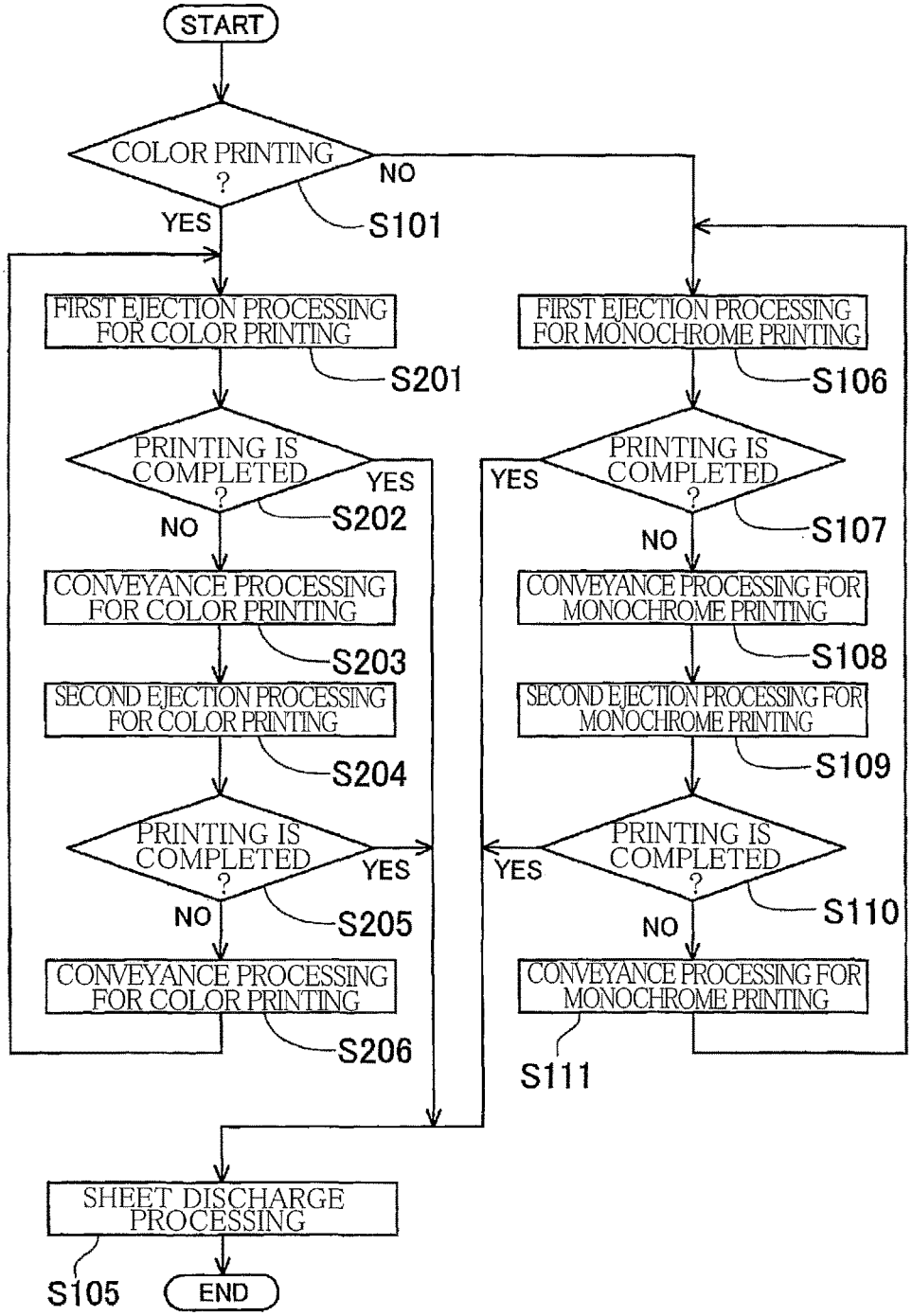
FIG. 13 is a flow chart for the sixth modification and corresponds to FIG. 4.

In this instance, the controller 40 executes control according to a flow chart of FIG. 13, in other words, printing processing according to the flow char of FIG. 13, when printing is performed by the ink-jet printer 1. As shown in FIG. 13, when the color printing is performed (S101: YES), the controller 40 executes the first ejection processing for color printing (S201). In the first ejection processing for color printing, the controller 40 controls the head drive ICs 31-34 and the carriage drive IC 36 such that the ink is ejected from the nozzles 10 of the nozzle rows 11*a*-14*a* while the ink-jet head 3 is moved toward the right side in the scanning direction.

When the printing is completed (S202: YES), the controller 40 executes the sheet discharge processing (S105), and the printing processing is ended. When the printing is not completed yet (S202: NO), the controller 40 executes conveyance processing for color printing (S203) similar to that of S105. Subsequently, the controller 40 executes the second ejection processing for color printing (S204). In the second ejection processing for color printing, the controller 40 controls the head drive ICs 31-34 and the carriage drive IC 36 such that the ink is ejected from the nozzles 10 of the nozzle rows 11*b*-14*b* while the ink-jet head 3 is moved toward the left side in the scanning direction.

When the printing is completed (S205: YES), the controller 40 executes the sheet discharge processing (S105), and the printing control is ended. On the other hand, when the printing is not completed yet (S205: NO), the controller 40 executes conveyance processing for color printing (S206) similar to that of S105, and the control flow returns to S201.

The control executed by the controller 40 when the monochrome printing is performed is similar to that explained in the illustrated embodiment, and explanation thereof is dispensed with. In the sixth modification, the printed image has a resolution half that in the illustrated embodiment.

In the illustrated embodiment, when the monochrome printing is performed, the ink ejected from the nozzle 10 of the nozzle row 11*a* and attached to the recording sheet P and the ink ejected from the nozzles 10 of the nozzle row 13*b* and attached to the recording sheet P are arranged on the recording sheet P in the conveyance direction. At a portion of the printed image having a high density, the ink ejected from the nozzles 10 of the nozzle row 11*a* and attached to the recording sheet P and the ink ejected from the nozzles 10 of the nozzle row 13*b* and attached to the recording sheet P are partly superposed on each other.

Similarly, the ink ejected from the nozzles 10 of the nozzle row 15*a* and attached to the recording sheet P and the ink ejected from the nozzles 10 of the nozzle row 15*b* and attached to the recording sheet P are arranged on the recording sheet P in the conveyance direction. At a portion of the printed image having a high density, the ink ejected from the nozzles 10 of the nozzle row 15*a* and attached to the recording sheet P and the ink ejected from the nozzles 10 of the nozzle row 15*b* and attached to the recording sheet P are partly superposed on each other.

In the meantime, in the illustrated embodiment, the distance between the nozzle row 11*a* and the nozzle row 13*b* in the scanning direction is larger than the distance between the nozzle row 15*a* and the nozzle row 15*b* in the scanning direction. In the first ejection processing for monochrome printing, therefore, a time before the ink ejected from the nozzles 10 of the nozzle row 11*a* is attached to the recording sheet P after the ink ejected from the nozzles 10 of the nozzle row 13*b* has been attached to the recording sheet P is longer than a time before the ink ejected from the nozzles 10 of the nozzle row 15*b* is attached to the recording sheet P after the ink ejected from the nozzles 10 of the nozzle row 15*a* has been attached to the recording sheet P.

Consequently, the ink ejected from the nozzles 10 of the nozzle row 11*a* is attached to the recording sheet P after the ink ejected from the nozzles 10 of the nozzle row 13*b* has been sufficiently dried on the recording sheet P. In contrast, the ink ejected from the nozzles 10 of the nozzle row 15*b* is attached to the recording sheet P before the ink ejected from the nozzles 10 of the nozzle row 15*a* is sufficiently dried on the recording sheet P. Thus, a part of the ink ejected from the nozzles 10 of the nozzle row 11*a* and attached to the recording sheet P, which part is superposed on the ink ejected from the nozzles 10 of the nozzle row 13*b* and attached to the recording sheet P, is not likely to sink into the recording sheet P, as compared with a part of the ink ejected from the nozzles 10 of the nozzle row 15*b* and attached to the recording sheet P, which part is superposed on the ink ejected from the nozzles 10 of the nozzle row 15*a* and attached to the recording sheet P.

Similarly, in the second ejection processing for monochrome printing, a time before the ink ejected from the nozzles 10 of the nozzle row 13*b* is attached to the recording sheet P after the ink ejected from the nozzles 10 of the nozzle row 11*a* has been attached to the recording sheet P is longer than a time before the ink ejected from the nozzles 10 of the nozzle row 15*a* is attached to the recording sheet P after the ink ejected from the nozzles 10 of the nozzle row 15*b* has been attached to the recording sheet P.

Consequently, the ink ejected from the nozzles 10 of the nozzle row 13*b* is attached to the recording sheet P after the ink ejected from the nozzles 10 of the nozzle row 11*a* has been sufficiently dried on the recording sheet P. In contrast, the ink ejected from the nozzles 10 of the nozzle row 15*a* is attached to the recording sheet P before the ink ejected from the nozzles 10 of the nozzle row 15*b* is sufficiently dried on the recording sheet P. Thus, a part of the ink ejected from the nozzles 10 of the nozzle row 13*b* and attached to the recording sheet P, which part is superposed on the ink ejected from the nozzles 10 of the nozzle row 11*a* and attached to the recording sheet P, is unlikely to sink into the recording sheet P, as compared with a part of the ink ejected from the nozzles 10 of the nozzle row 15*a* and attached to the recording sheet P, which part is superposed on the ink ejected from the ink from the nozzles 10 of the nozzle row 15*b* and attached to the recording sheet P.

If the monochrome printing is performed such that the same volume of the ink is ejected from each of the nozzles 10 of the nozzle rows 11*a,* 13*b* and each of the nozzles 10 of the nozzle rows 15*a,* 15*b,* a portion of the printed image formed by the ink ejected from the nozzles 10 of the nozzle rows 11*a,* 13*b* has a higher density than a portion of the printed image formed by the nozzles 10 of the nozzle rows 15*a,* 15*b,* so that the printed image may suffer from unevenness in density.

In view of the above, the manner according to which the ink is ejected from the nozzles 10 may be varied between the nozzle rows 11*a,* 13*b* and the nozzle rows 15*a,* 15*b,* for obviating the unevenness in density of the printed image.

Figure 14A:
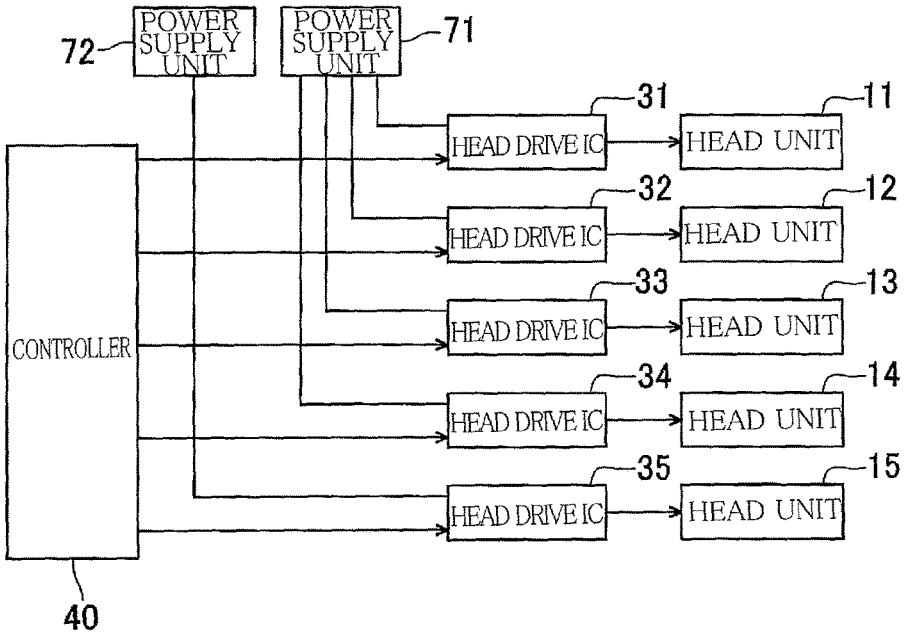
FIG. 14A is a view for explaining connection between head drive ICs and power supply units in a seventh modification and FIG. 14B is a view for explaining connection between the head drive ICs and a power supply unit in an eighth modification.
Figure 14B:
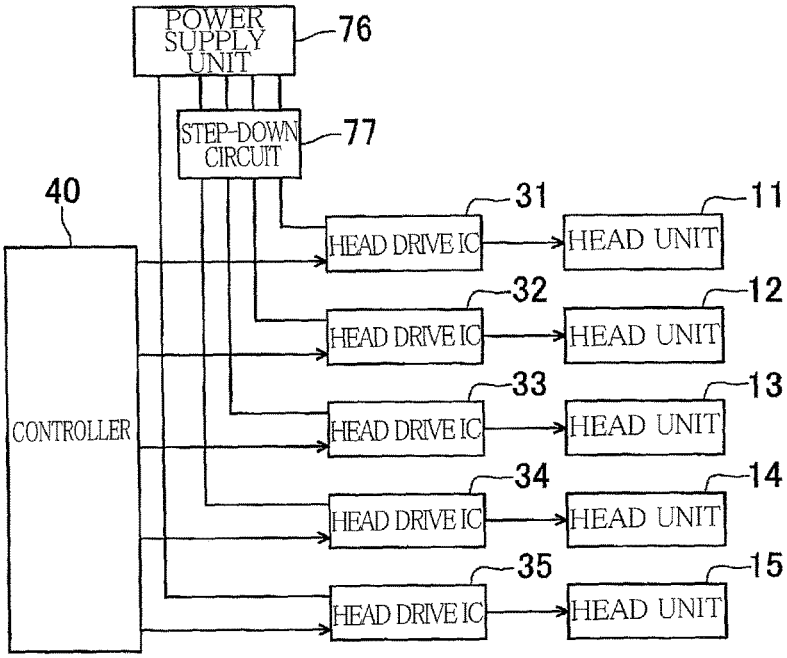

In a seventh modification shown in FIG. 14A, for instance, the ink-jet printer 1 has a power supply unit 71 configured to supply power to the head drive ICs 31-34 and a power supply unit 72, different from the power supply unit 71, configured to supply power to the head drive IC 35. In an eighth modification shown in FIG. 14B, the ink-jet printer 1 has a power supply unit 76 and a step-down circuit 77. The power supply unit 76 is connected to the head drive ICs 31-34 via the step-down circuit 77. The power supply unit 76 is connected directly to the drive IC 35 not via the step-down circuit 77.

In the seventh and eighth modifications, a drive voltage applied to the head unit 15 by the head drive IC 35 is higher than a drive voltage applied to the head units 11-14 by the head drive ICs 31-34. Consequently, when the same drive signal to command ejection of the black ink is received in the head units 11, 13, 15, the volume of the ink ejected from each of the nozzles 10 of the nozzle rows 15*a,* 15*b* is larger than the volume of the ink ejected from each of the nozzles 10 of the nozzle rows 11*a,* 13*b*. As a result, the above-indicated unevenness in density of the printed image can be obviated.

Alternatively, the controller 40 may be configured to control the head drive ICs 31, 33, 35 such that the duty with respect to the density of the image to be printed is made higher for the nozzles 10 of the nozzle rows 15*a,* 15*b* than for the nozzles 10 of the nozzle rows 11*a,* 13*b*. Also in this instance, it is possible to obviate the above-indicated unevenness in density in the monochrome printing.

In the illustrated embodiment, there exist, in the ink-jet head 3, spaces in each of which no head units are disposed. Specifically, the head units are not disposed in an area (position) of the head holder 20 located upstream of the head unit 15 in the conveyance direction and areas (positions) of the head holder 20 located on opposite sides of the head unit 15 in the scanning direction. Various components may be disposed in those areas.

Figure 15:
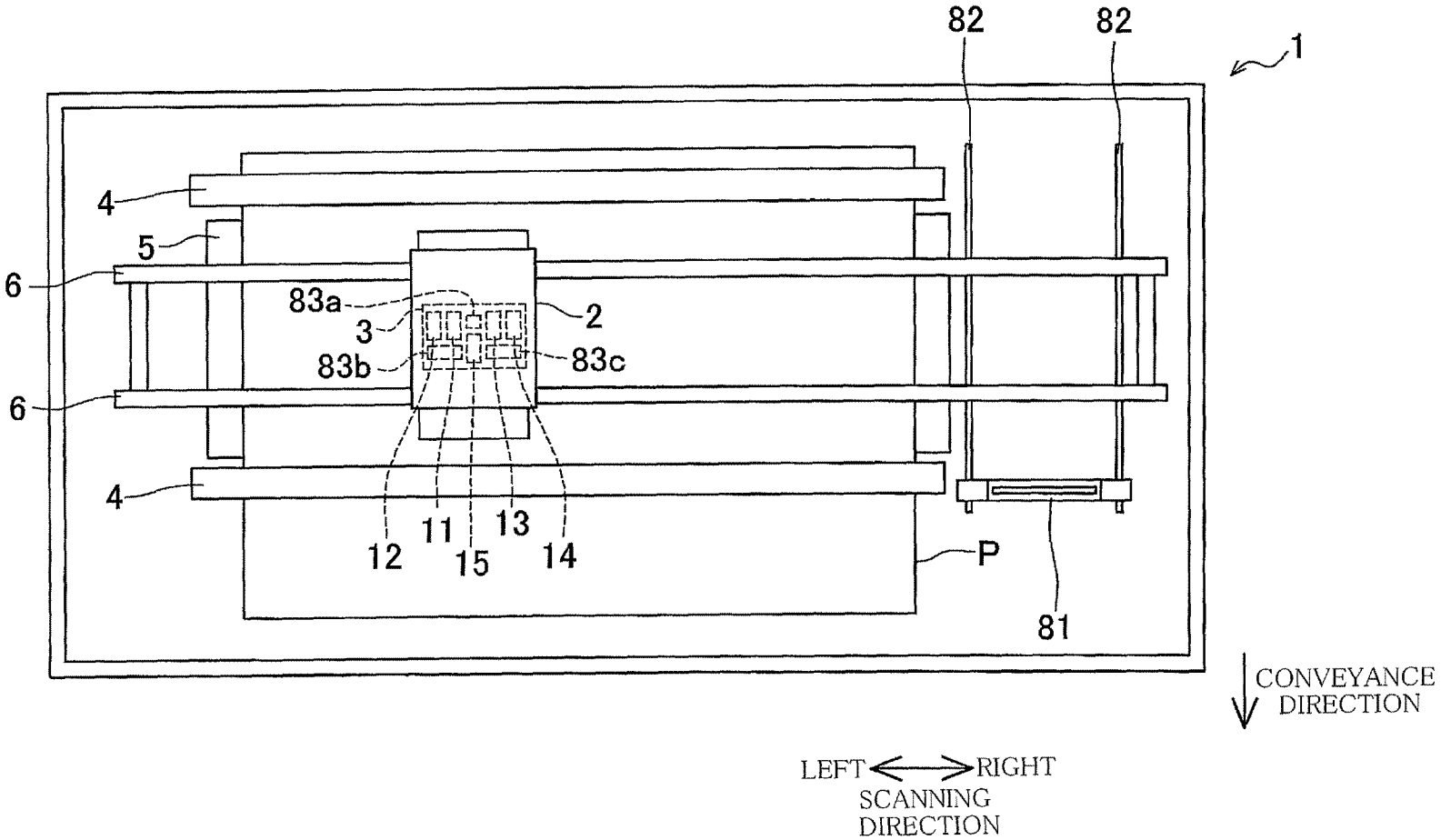
FIG. 15 is a view for explaining a ninth modification and corresponds to FIG. 1.
Figure 16:
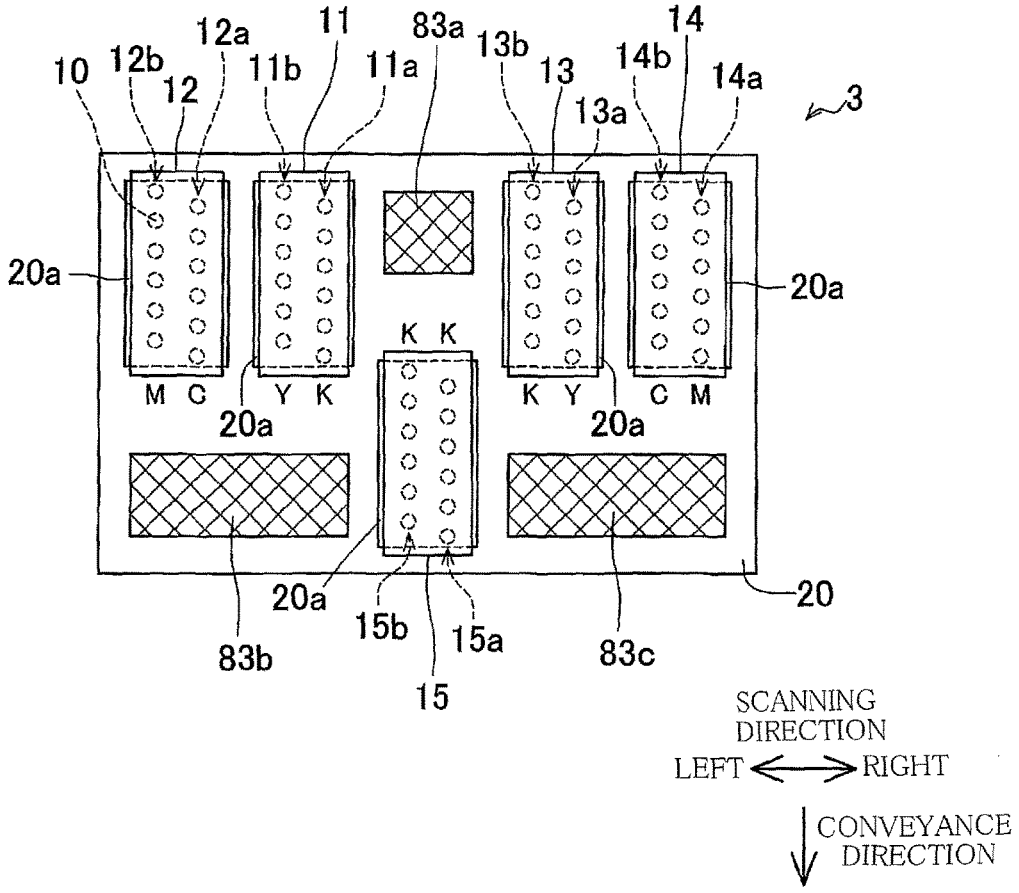
FIG. 16 is a view for explaining the ninth modification and corresponds to FIG. 2.

In a ninth modification shown in FIG. 15, for instance, the ink-jet printer 1 has a wiper 81 disposed in an area located on the right side, in the scanning direction, of an area in which the sheet conveyance rollers 4 and the platen 5 are disposed. The wiper 81 performs a wiping operation for wiping off the ink attached to the nozzle surfaces of the head unit 11-15, namely, the surface of the ink-jet head 3, in which the nozzles 10 are formed. The wiper 81 extends in the scanning direction so as to have substantially the same dimension as the ink-jet head 3 in the scanning direction. The wiper 81 is supported by two guide rails 82 extending in a direction parallel to the conveyance direction. When a wiper driving device (not shown) is driven, the wiper 81 is moved along the guide rails 82 in the direction parallel to the conveyance direction. Further, as shown in FIG. 16, ink absorbing foams 83*a*-83*c* (each as one example of an ink absorber) are provided in the following areas of the head holder 20: the area located upstream of the head unit 15 in the conveyance direction; and the areas located on opposite sides of the head unit 15 in the scanning direction.

In this arrangement, in a state before the wiping operation is performed, the wiper 81 is disposed downstream of the carriage 2 in the conveyance direction. When the wiping operation is performed, the carriage 2 is moved rightward in the scanning direction until the ink-jet head 3 reaches the area in which the wiper 81 is disposed. In this state, the wiper 81 is moved toward the upstream side in the conveyance direction such that the wiper 81 is located upstream of the carriage 2. Thereafter, the wiper 81 is moved toward the downstream side in the conveyance direction such that the wiper 81 returns to the original position. Thus, the ink attached to the nozzle surfaces of the head units 11-15 are wiped off by the wiper 81. When the wiper 81 is moved toward the upstream side in the conveyance direction, the ink on the nozzle surface of the head unit 15 that has been wiped off by the wiper 81 is absorbed mainly by the ink absorbing foam 83*a*. When the wiper 81 is moved toward the downstream side in the conveyance direction, the ink on the nozzle surfaces of the head units 11-14 that has been wiped off by the wiper 81 is absorbed mainly by the ink absorbing foams 83*b*, 83*c*.

While the three ink absorbing foams 83*a*-83*c* are provided in the ninth modification, only one or two of the three ink absorbing foams 83*a*-83*c* may be provided.

Figure 17:
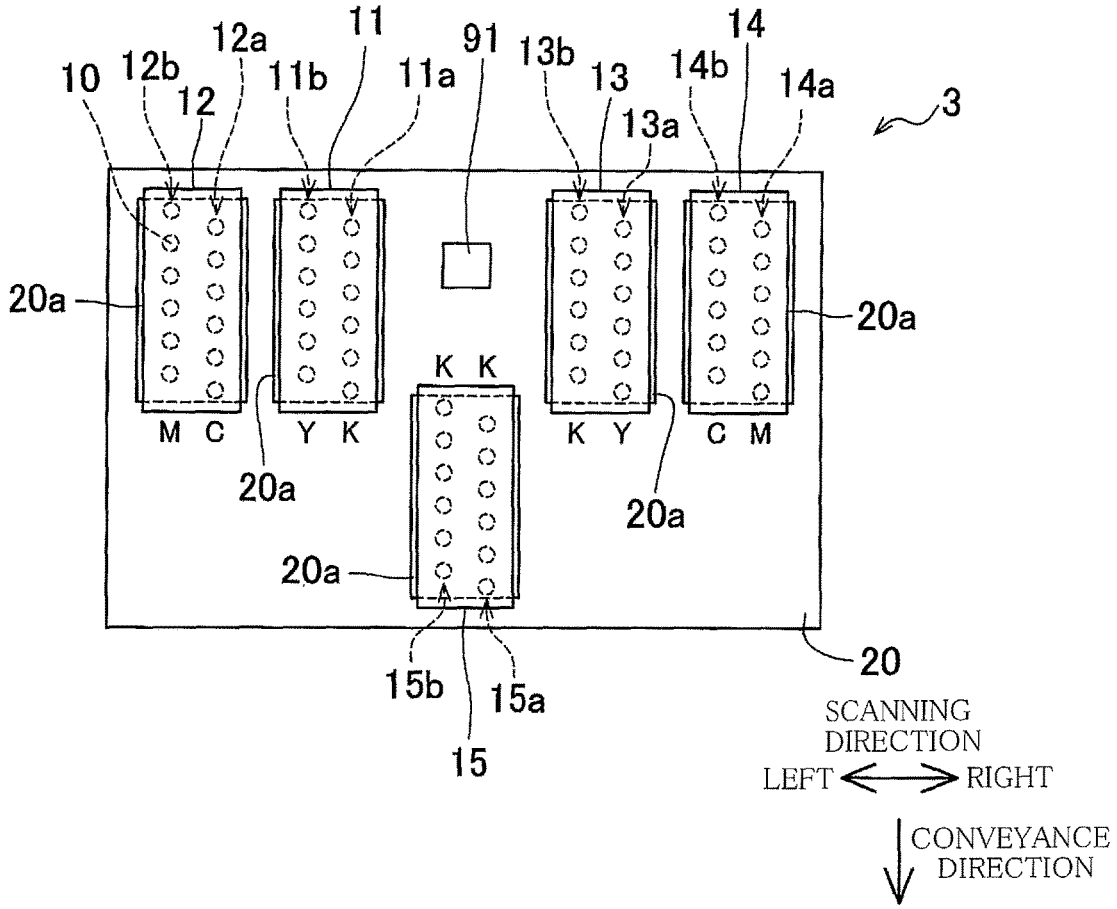
FIG. 17 is a view for explaining a tenth modification and corresponds to FIG. 2.

In a tenth modification shown in FIG. 17, a media sensor 91 (as one example of a recording-medium detector) is provided in the area of the head holder 20 located upstream of the head unit 15 in the conveyance direction. The media sensor 91 is configured to detect the recording sheet P. Specifically, the media sensor 91 is configured to emit light toward the platen 5 and to receive reflected light. In the tenth modification, the color of the platen 5 is black. In a state in which the recording sheet P is not present on a portion of the platen 5 that is opposed to the media sensor 91, the light emitted from the media sensor 91 is hardly reflected by the platen 5, and the amount of the reflected light received by the media sensor 91 is accordingly small. On the other hand, in a state in which the white recording sheet P is present on the portion of the platen 5 that is opposed to the media sensor 91, the light emitted from the media sensor 91 is reflected by the recording sheet P, and the amount of the reflected light received by the media sensor 91 is accordingly large. In this way, the media sensor 91 determines whether or not the recording sheet P is present based on the amount of the received reflected light.

In the tenth modification, the media sensor 91 is provided in the area of the head holder 20 located upstream of the head unit 15 in the conveyance direction. The media sensor 91 may be provided in other area. For instance, the media sensor 91 may be provided in one of two areas of the head holder 20 that are located on the opposite sides of the head unit 15 in the scanning direction.

As described above, it is conceivable that the media sensor 91 may be provided in one of the two areas of the head holder 20 that are located on the opposite sides of the head unit 15 in the scanning direction. In this respect, the carriage 2 may incline in a plane parallel to the scanning direction and the conveyance direction when the carriage 2 moves along the guide rails 6 in the scanning direction. If the carriage 2 inclines in the plane, the position of the media sensor 91 in the conveyance direction changes. Further, the two areas of the head holder 20 located on the opposite sides of the head unit 15 in the scanning direction are more distant, in the scanning direction, from the center position of the head holder 20 than the area of the head holder 20 located upstream of the head unit 15 in the conveyance direction. Consequently, in a case where the media sensor 91 is disposed in one of the two areas of the head holder 20 that are located on the opposite sides of the head unit 15 in the scanning direction, an amount of deviation of the position of the media sensor 91 in the conveyance direction when the carriage 2 inclines is larger than a case where the media sensor 91 is disposed in the area of the head holder 20 that is located upstream of the head unit 15 in the conveyance direction.

For obtaining a high degree of detection accuracy of the media sensor 91, the media sensor 91 is preferably provided in the area of the head holder 20 located upstream of the head unit 15 in the conveyance direction, rather than the two areas of the head holder 20 that are located on the opposite sides of the head unit 15 in the scanning direction.

Figure 18:
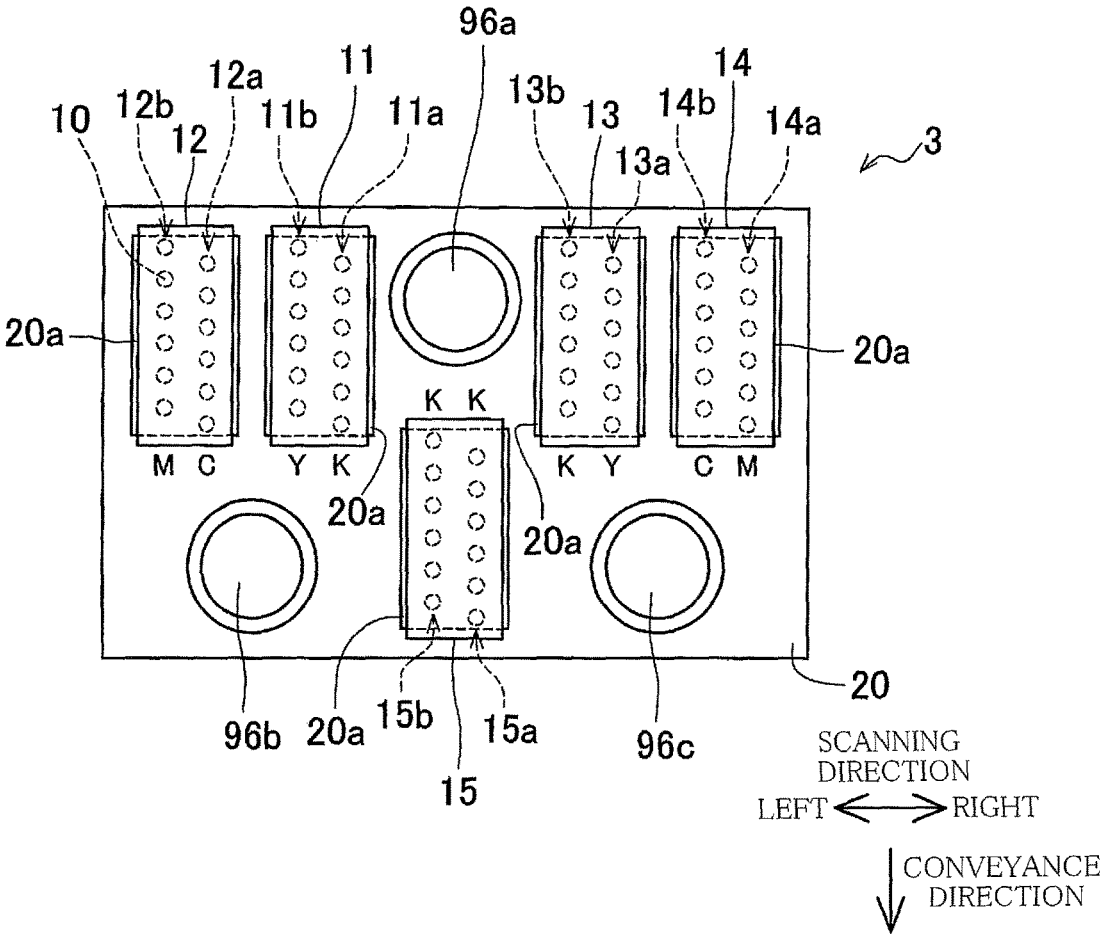
FIG. 18 is a view for explaining an eleventh modification and corresponds to FIG. 2.

In an eleventh modification shown in FIG. 18, mist suction openings 96*a*-96*c* are formed in the area of the head holder 20 that is located upstream of the head unit 15 in the conveyance direction and the two areas of the head holder 20 that are located on the opposite sides of the head unit 15 in the scanning direction. The mist suction openings 96*a*-96*c* are connected to a suction pump (not shown) through tubes (not shown).

In the eleventh modification, the suction pump connected to the mist suction openings 96*a*-96*c* is driven when the printing is performed. As a result, mist of the ink generated when the ink is ejected from the nozzles 10 is sucked through the mist suction openings 96*a*-96*c*, so that the mist of the ink is prevented from being attached to the nozzle surfaces of the head units 11-15.

While the three mist suction openings 96*a*-96*c* are formed in the eleventh modification, only one or two of the three mist suction openings 96*a*-96*c* may be formed.

While the head units 11-14 are located at completely the same position in the conveyance direction in the illustrated embodiment and the first through eleventh modifications, the head units 11-14 may be shifted relative to each other in the conveyance direction as long as the shift amount is as small as less than the nozzle pitch A.

Figure 19:
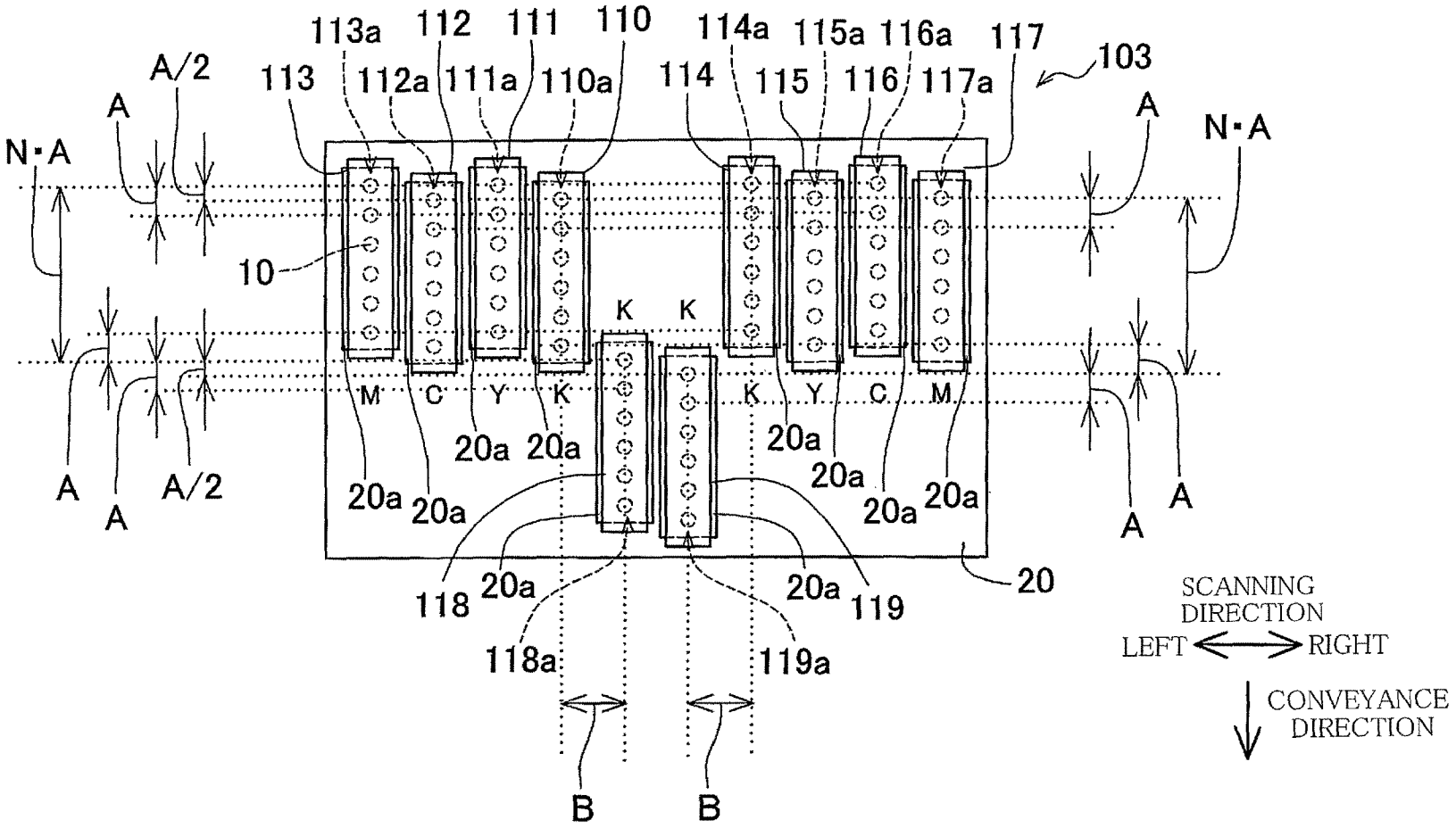
FIG. 19 is a view for explaining a twelfth modification and corresponds to FIG. 2.

While each head unit has two nozzle rows in the illustrated embodiment and the first through eleventh modifications, each head unit may be configured otherwise. An ink-jet head 103 in a twelfth modification shown in FIG. 19 has ten head units 110-119 that are identical with one another in structure. Each of the head units 110-119 has one nozzle row.

The head units 110-119 will be hereinafter explained. The head unit 110 (as one example of a first head unit) ejects the black ink from the nozzles 10 of a nozzle row 110*a* (as one example of a first nozzle row). The head unit 111 (as one example of a second head unit) is disposed alongside the head unit 110 in the scanning direction, namely, disposed on the left side of the head unit 110 in the scanning direction and ejects the yellow ink from the nozzles 10 of a nozzle row 111*a* (as one example of a second nozzle row). The head unit 112 is disposed on the left side of the head unit 111 in the scanning direction and ejects the cyan ink from the nozzles 10 of a nozzle row 112*a*. The head unit 113 is disposed on the left side of the head unit 112 in the scanning direction and ejects the magenta ink from the nozzles 10 of a nozzle row 113*a*. The head unit 110 and the head unit 112 are located at the same position in the conveyance direction. The head units 111, 113 are shifted from the head units 110, 112 toward the upstream side in the conveyance direction by the distance "A/2" corresponding to half the nozzle pitch A.

The head unit 114 (as one example of a third head unit) is disposed on the right side of the head unit 110 so as to be spaced apart from the head unit 110 in the scanning direction. The head unit 114 ejects the black ink from the nozzles 10 of a nozzle row 114*a* (as one example of a third nozzle row). The head unit 115 (as one example of a fourth head unit) is disposed alongside the head unit 114 in the scanning direction, namely, disposed on the right side of the head unit 114 in the scanning direction and ejects the yellow ink from the nozzles 10 of a nozzle row 115*a* (as one example of a fourth nozzle row). The head unit 116 is disposed on the right side of the head unit 115 in the scanning direction and ejects the cyan ink from the nozzles 10 of a nozzle row 116*a*. The head unit 117 is disposed on the right side of the head unit 116 in the scanning direction and ejects the magenta ink from the nozzles 10 of a nozzle row 117*a*. The head units 115, 117 are located at the same position as the head unit 110, 112 in the conveyance direction. The head units 114, 116 are located at the same position as the head units 111, 113 in the conveyance direction. The head units 114, 116 are shifted from the head units 115, 117 toward the upstream side in the conveyance direction by the distance "A/2" corresponding to half the nozzle pitch A.

The head unit 118 (as one example of a fifth head unit) is disposed between the head unit 110 and the head unit 114 in the scanning direction. The head unit 118 is shifted from the head units 111, 113, 114, 116 toward the downstream side in the conveyance direction by the distance "N·A". The head unit 118 ejects the black ink from the nozzles 10 of a nozzle row 118*a* (as one example of a fifth nozzle row). The head unit 119 (as one example of a sixth head unit) is disposed between the head unit 110 and the head unit 114 in the scanning direction so as to be disposed alongside the head unit 118, namely, disposed on the right side of the head unit 118. The head unit 119 is shifted from the head units 110, 112, 115, 117 toward the downstream side in the conveyance direction by the distance "N·A". The head unit 119 ejects the black ink from the nozzles 10 of a nozzle row 119*a* (as one example of a sixth nozzle row).

In this twelfth modification, the printing is performed by executing printing processing according to the flow chart shown FIG. 4, as in the illustrated embodiment. In the first ejection processing for color printing of S102 of the twelfth modification, the ink is ejected from the nozzles 10 of the nozzle rows 110*a*, 112*a*, 115*a*, 117*a* while the ink-jet head 103 is moved toward the right side in the scanning direction. In the second ejection processing for color printing of S103, the ink is ejected from the nozzles 10 of the nozzle rows 111*a*, 113*a*, 114*a*, 116*a* while the ink-jet head 103 is moved toward the left side in the scanning direction.

In the first ejection processing for monochrome printing of S107, the black ink is ejected from the nozzles 10 of the nozzle rows 110*a*, 114*a*, 118*a*, 119*a* while the ink-jet head 103 is moved toward the right side in the scanning direction. In the second ejection processing for monochrome printing of S110, the black ink is ejected from the nozzles 10 of the nozzle rows 110*a*, 114*a*, 118*a*, 119*a* while the ink-jet head 103 is moved toward the left side in the scanning direction.

In the twelfth modification, the black ink may be ejected from the nozzles 10 of the nozzle rows 111*a*, 115*a*, and the yellow ink may be ejected from the nozzles 10 of the nozzle rows 110*a*, 114*a*.

While the plurality of head units of the ink-jet head have mutually the same flow-path structure in the illustrated embodiment and the first through twelfth modifications, the flow-path structure may differ in some of the head units.

What is claimed is:

1. An ink-jet head configured to eject ink from a plurality of nozzles, comprising a plurality of head units each of which has two nozzle rows, each nozzle row being formed by a plurality of ink nozzles from which the ink is ejected and which are arranged at a predetermined nozzle pitch in a nozzle arrangement direction, the two nozzle rows being arranged in an orthogonal direction which is orthogonal to the nozzle arrangement direction, wherein the plurality of head units include a first head unit, a second head unit disposed so as to be spaced apart from the first head unit in the orthogonal direction such that the second head unit is shifted from the first head unit in the nozzle arrangement direction by a distance less than the nozzle pitch, a third head unit disposed between the first head unit and the second head unit in the orthogonal direction such that the third head unit is shifted from the first head unit in the nozzle arrangement direction by a distance corresponding to a predetermined natural number multiple of the nozzle pitch, wherein the first head unit has, as the two nozzle rows, a first nozzle row formed by nozzles, as the plurality of ink nozzles, from which first ink is ejected and a second nozzle row formed by nozzles, as the plurality of ink nozzles, from which second ink that differs in color from the first ink is ejected, wherein the second head unit has, as the two nozzle rows, a third nozzle row formed by nozzles, as the plurality of ink nozzles, from which the first ink is ejected and a fourth nozzle row formed by nozzles, as the plurality of ink nozzles, from which the second ink is ejected, wherein the third head unit has, as the two nozzle rows, a fifth nozzle row and a sixth nozzle row each of which is formed by nozzles, as the plurality of ink nozzles, from which the first ink is ejected, and wherein the second nozzle row is more distant, in the orthogonal direction, from the second head unit than the first nozzle row and the fourth nozzle row is more distant, in the orthogonal direction, from the first head unit than the third nozzle row, or the first nozzle row is more distant, in the orthogonal direction, from the second head unit than the second nozzle row and the third nozzle row is more distant, in the orthogonal direction, from the first head unit than the fourth nozzle row.

2. The ink-jet head according to claim 1, wherein the first ink is black ink and the second ink is color ink, and wherein the third head unit is disposed so as to be shifted from the first head unit and the second head unit in the nozzle arrangement direction.

3. The ink-jet head according to claim 1, wherein the plurality of ink nozzles of one of the two nozzle rows of each of the head units and the plurality of ink nozzles of the other of the two nozzle rows are shifted relative to each other in the nozzle arrangement direction by a distance corresponding to half the nozzle pitch.

4. The ink-jet head according to claim 1, wherein, where the number of the plurality of ink nozzles of each nozzle row from which the ink is ejected is defined as N, the third head unit is shifted from the first head unit in the nozzle arrangement direction by a distance corresponding to an amount N times the nozzle pitch.

5. The ink-jet head according to claim 1, wherein a distance between the first nozzle row and the fifth nozzle row in the orthogonal direction is the same as a distance between the third nozzle row and the sixth nozzle row in the orthogonal direction.

6. An ink-jet head configured to eject ink from a plurality of nozzles, comprising a plurality of head units each of which has two nozzle rows, each nozzle row being formed by a plurality of ink nozzles from which the ink is ejected and which are arranged at a predetermined nozzle pitch in a nozzle arrangement direction, the two nozzle rows being arranged in an orthogonal direction which is orthogonal to the nozzle arrangement direction, wherein the plurality of head units include a first head unit, a second head unit disposed so as to be spaced apart from the first head unit in the orthogonal direction such that the second head unit is shifted from the first head unit in the nozzle arrangement direction by a distance less than the nozzle pitch, a third head unit disposed so as to be spaced apart from the first head unit in the orthogonal direction such that the third head unit is shifted from the first head unit in the nozzle arrangement direction by a distance corresponding to a predetermined natural number multiple of the nozzle pitch, wherein the first head unit has, as the two nozzle rows, a first nozzle row formed by nozzles, as the plurality of ink nozzles, from which first ink is ejected and a second nozzle row formed by nozzles, as the plurality of ink nozzles, from which second ink that differs in color from the first ink is ejected, wherein the second head unit has, as the two nozzle rows, a third nozzle row formed by nozzles, as the plurality of ink nozzles, from which the first ink is ejected and a fourth nozzle row formed by nozzles, as the plurality of ink nozzles, from which the second ink is ejected, and wherein the third head unit has, as the two nozzle rows, a fifth nozzle row and a sixth nozzle row each of which is formed by nozzles, as the plurality of ink nozzles, from which the first ink is ejected.

7. The ink-jet head according to claim 6, wherein the third head unit is disposed between the first head unit and the second head unit in the orthogonal direction, and wherein the second nozzle row is more distant, in the orthogonal direction, from the third head unit than the first nozzle row and the fourth nozzle row is more distant, in the orthogonal direction, from the third head unit than the third nozzle row.

* * * * *